US011304020B2

(12) United States Patent
Jot et al.

(10) Patent No.: US 11,304,020 B2
(45) Date of Patent: Apr. 12, 2022

(54) IMMERSIVE AUDIO REPRODUCTION SYSTEMS

(71) Applicant: DTS, Inc., Calabasas, CA (US)

(72) Inventors: Jean-Marc Jot, Aptos, CA (US); Daekyoung Noh, Huntington Beach, CA (US); Ryan James Cassidy, San Diego, CA (US); Themis George Katsianos, Highland, CA (US); Oveal Walker, Chatsworth, CA (US)

(73) Assignee: DTS, Inc., Calabasas, CA (US)

( * ) Notice: Subject to any disclaimer, the term of this patent is extended or adjusted under 35 U.S.C. 154(b) by 24 days.

(21) Appl. No.: 16/813,973

(22) Filed: Mar. 10, 2020

(65) Prior Publication Data

US 2020/0213800 A1 Jul. 2, 2020

Related U.S. Application Data

(63) Continuation of application No. 15/587,903, filed on May 5, 2017, now abandoned.

(Continued)

(51) Int. Cl.

*H04S 7/00* (2006.01)
*H04S 3/00* (2006.01)

(Continued)

(52) U.S. Cl.

CPC ..... *H04S 7/302* (2013.01); *H04S 3/002* (2013.01); *H04S 1/002* (2013.01); *H04S 5/005* (2013.01);

(Continued)

(58) Field of Classification Search

CPC ..... H04S 7/302; H04S 3/002; H04S 5/005; H04S 2400/01; H04S 2400/03;

(Continued)

(56) References Cited

U.S. PATENT DOCUMENTS 4,817,149 A 3/1989 Myers
5,742,689 A 4/1998 Tucker et al.

(Continued)

FOREIGN PATENT DOCUMENTS

CN 104604257 A 5/2015
CN 105376691 A 3/2016

(Continued)

OTHER PUBLICATIONS

U.S. Appl. No. 15/587,903, filed May 5, 2017, Immersive Audio Reproduction Systems.

(Continued)

*Primary Examiner* — Matthew A Eason
*Assistant Examiner* — Kuassi A Ganmavo
(74) *Attorney, Agent, or Firm* — Schwegman Lundberg & Woessner, P.A.

(57) ABSTRACT

Systems and methods can provide an elevated, virtual loudspeaker source in a three-dimensional soundfield using loudspeakers in a horizontal plane. In an example, a processor circuit can receive at least one height audio signal that includes information intended for reproduction using a loudspeaker that is elevated relative to a listener, and optionally offset from the listener's facing direction by a specified azimuth angle. A first virtual height filter can be selected for use based on the specified azimuth angle. A virtualized audio signal can be generated by applying the first virtual height filter to the at least one height audio signal. When the virtualized audio signal is reproduced using one or more loudspeakers in the horizontal plane, the virtualized audio signal can be perceived by the listener as originating from an elevated loudspeaker source that corresponds to the azimuth angle.

18 Claims, 14 Drawing Sheets

Related U.S. Application Data

(60) Provisional application No. 62/332,872, filed on May 6, 2016.

(51) Int. Cl.
*H04S 5/00* (2006.01)
*H04S 1/00* (2006.01)

(52) U.S. Cl.
CPC ..... *H04S 2400/01* (2013.01); *H04S 2400/03* (2013.01); *H04S 2400/07* (2013.01); *H04S 2400/11* (2013.01); *H04S 2420/01* (2013.01)

(58) Field of Classification Search
CPC .. H04S 2400/11; H04S 2420/01; H04S 1/002; H04S 7/30; H04S 2400/07
See application file for complete search history.

(56) References Cited

U.S. PATENT DOCUMENTS 5,943,427 A 8/1999 Massie et al.
6,078,669 A 6/2000 Maher
6,175,631 B1 1/2001 Davis et al.
6,421,446 B1 7/2002 Cashion et al.
6,498,857 B1 12/2002 Sibbald
6,766,028 B1 7/2004 Dickens
6,956,954 B1 10/2005 Takemura et al.
6,961,439 B2 11/2005 Ballas
7,092,541 B1 8/2006 Eberbach
7,158,642 B2 1/2007 Tsuhako
7,177,431 B2 * 2/2007 Davis ..... H04R 5/04 381/1
7,415,123 B2 8/2008 Ballas
7,480,389 B2 1/2009 Ricks et al.
7,606,377 B2 10/2009 Melanson
7,702,116 B2 4/2010 Stone et al.
7,876,914 B2 1/2011 Grosvenor et al.
8,000,485 B2 8/2011 Walsh et al.
8,023,660 B2 9/2011 Faller
8,027,477 B2 9/2011 Wang
8,126,172 B2 2/2012 Horbach et al.
8,150,061 B2 4/2012 Ozawa
8,254,583 B2 8/2012 Kim
8,270,616 B2 9/2012 Slamka et al.
8,325,933 B2 12/2012 Melchior et al.
8,374,365 B2 2/2013 Goodwin et al.
8,442,244 B1 5/2013 Long, Jr.
8,532,305 B2 9/2013 Vickers
8,638,946 B1 1/2014 Mahabub
8,712,061 B2 4/2014 Jot et al.
8,885,834 B2 11/2014 Kuhr et al.
8,976,972 B2 3/2015 Emerit et al.
9,009,057 B2 4/2015 Breebaart et al.
9,100,767 B2 8/2015 Van Baelen et al.
9,167,369 B2 10/2015 Takumai et al.
9,264,838 B2 2/2016 Stein et al.
10,979,844 B2 4/2021 Noh et al.
2001/0040968 A1 11/2001 Mukojima
2006/0083394 A1 4/2006 McGrath
2006/0198527 A1 * 9/2006 Chun ..... H04S 3/008 381/17
2007/0061026 A1 3/2007 Wang
2007/0160216 A1 7/2007 Nicol et al.
2008/0004729 A1 1/2008 Hiipakka
2008/0037796 A1 * 2/2008 Jot ..... H04S 5/00 381/17
2008/0273708 A1 11/2008 Sandgren et al.
2009/0046864 A1 2/2009 Mahabub et al.
2010/0303246 A1 12/2010 Walsh et al.
2011/0081024 A1 4/2011 Soulodre
2011/0222693 A1 9/2011 Lee et al.
2011/0243338 A1 10/2011 Brown
2012/0008789 A1 * 1/2012 Kim ..... H04S 3/002 381/17
2013/0156213 A1 6/2013 Pan et al.
2013/0202117 A1 8/2013 Brungart et al.
2013/0308800 A1 11/2013 Bacon
2014/0023197 A1 1/2014 Xiang et al.
2014/0072121 A1 3/2014 Harma et al.
2014/0100856 A1 4/2014 Beack et al.
2014/0185811 A1 7/2014 Stein et al.
2014/0270185 A1 9/2014 Walsh
2014/0334626 A1 11/2014 Lee et al.
2015/0131824 A1 5/2015 Nguyen et al.
2015/0146873 A1 5/2015 Chabanne et al.
2015/0223002 A1 8/2015 Mehta et al.
2015/0304791 A1 10/2015 Crockett
2015/0350802 A1 * 12/2015 Jo ..... H04S 5/005 381/1
2015/0373454 A1 12/2015 Shidoji
2015/0382127 A1 12/2015 Sun et al.
2016/0044431 A1 2/2016 Kraemer et al.
2016/0044434 A1 * 2/2016 Chon ..... H04S 5/005 381/18
2016/0050508 A1 2/2016 Redmann
2016/0111096 A1 4/2016 Oh et al.
2016/0133263 A1 5/2016 Borss et al.
2016/0134989 A1 5/2016 Herre et al.
2016/0142853 A1 * 5/2016 Herre ..... H04S 7/303 381/23
2017/0011751 A1 1/2017 Fueg et al.
2017/0094438 A1 3/2017 Chon et al.
2017/0188169 A1 6/2017 Chon et al.
2017/0223477 A1 * 8/2017 Chon ..... H04S 3/008
2017/0289724 A1 * 10/2017 Breebaart ..... H04S 7/30
2017/0325043 A1 11/2017 Jot et al.
2018/0014135 A1 * 1/2018 Chung ..... H04S 3/008
2018/0262858 A1 9/2018 Noh et al.

FOREIGN PATENT DOCUMENTS

CN 104604257 B 5/2016
CN 102272840 B 2/2017
EP 2866227 A1 4/2015
EP 3125240 A1 2/2017
KR 20120004916 A 1/2012
KR 101202368 B1 11/2012
WO WO-2013149867 A1 10/2013
WO WO-2014036121 A1 3/2014
WO WO-2016130834 A1 8/2016
WO WO-2017097324 A1 6/2017
WO WO-2017192972 A1 11/2017
WO WO-2018164750 A1 9/2018

OTHER PUBLICATIONS

U.S. Appl. No. 15/844,096, filed Dec. 15, 2017, Distributed Audio Virtualization Systems.
"U.S. Appl. No. 15/587,903, Response filed Jan. 9, 2019 to Final Office Action dated Aug. 9, 2018", 22 pgs.
"U.S. Appl. No. 15/587,903, Advisory Action dated Nov. 30, 2018", 4 pgs.
"U.S. Appl. No. 15/587,903, Examiner Interview Summary filed Nov. 8, 2018", 1 pg.
"U.S. Appl. No. 15/587,903, Final Office Action dated Aug. 9, 2018", 26 pgs.
"U.S. Appl. No. 15/587,903, Final Office Action dated Dec. 31, 2019", 30 pgs.
"U.S. Appl. No. 15/587,903, Non Final Office Action dated May 31, 2019", 25 pgs.
"U.S. Appl. No. 15/587,903, Non Final Office Action dated Dec. 14, 2017", 26 pgs.
"U.S. Appl. No. 15/587,903, Response filed Apr. 16, 2018 to Non Final Office Action dated Dec. 14, 2017", 15 pgs.
"U.S. Appl. No. 15/587,903, Response filed Oct. 9, 2018 to Final Office Action dated Aug. 9, 2018", 17 pgs.
"U.S. Appl. No. 15/587,903, Response filed Sep. 5, 2019 to Non-Final Office Action dated May 31, 2019", 29 pgs.
"U.S. Appl. No. 15/844,096, Examiner Interview Summary dated Jan. 21, 2020", 3 pgs.

(56) References Cited

OTHER PUBLICATIONS

"U.S. Appl. No. 15/844,096, Final Office Action dated Nov. 18, 2019", 15 pgs.
"U.S. Appl. No. 15/844,096, Non Final Office Action dated Mar. 26, 2020", 15 pgs.
"U.S. Appl. No. 15/844,096, Non Final Office Action dated Jul. 18, 2019", 17 pgs.
"U.S. Appl. No. 15/844,096, Response filed Feb. 18, 2020 to Final Office Action dated Nov. 18, 2019", 16 pgs.
"U.S. Appl. No. 15/844,096, Response filed May 10, 2019 to Restriction Requirement dated Mar. 22, 2019", 8 pgs.
"U.S. Appl. No. 15/844,096, Response filed Jun. 26, 2020 to Non Final Office Action dated Mar. 26, 2020", 13 pgs.
"U.S. Appl. No. 15/844,096, Response filed Oct. 18, 2019 to Non-Final Office Action dated Jul. 18, 2019", 18 pgs.
"U.S. Appl. No. 15/844,096, Restriction Requirement dated Mar. 22, 2019", 6 pgs.
"International Application Serial No. PCT/US2017/031269, International Preliminary Report on Patentability dated Nov. 15, 2018", 15 pgs.
"International Application Serial No. PCT/US2017/031269, International Search Report dated Sep. 1, 2017", 4 pgs.
"International Application Serial No. PCT/US2017/031269, Invitation to Pay Add'l Fees and Partial Search Report dated Jun. 22, 2017", 2 pgs.
"International Application Serial No. PCT/US2017/031269, Written Opinion dated Sep. 1, 2017", 13 pgs.
"International Application Serial No. PCT/US2017/067026, International Preliminary Report on Patentability dated Sep. 19, 2019", 11 pgs.
"International Application Serial No. PCT/US2017/067026, International Search Report dated Mar. 8, 2018", 2 pgs.
"International Application Serial No. PCT/US2017/067026, Written Opinion dated Mar. 8, 2018", 9 pgs.
Breebaart, Jeroen, et al., "Phantom Materialization: a Novel Method to Enhance Stereo Audio Reproduction on Headphones", IEEE Trans. Audi o, Speech and Language Proc. 16(8), (Nov. 2008), 1503-1511.
Jo, H, et al., "Applying spectral cues to generate elevated sound sources displayed via ear-level loudspeakers", Proc. Internoise, (Sep. 2011), 1-6.
Jo, Hyun, et al., "Confirming the Perception of Virtual Source Elevation Effects Created using 5.1 Channel Surround Sound Playback", Proc. ACM SIGGRAPH Sponsored 9th Int. Conf. on VRCAI, (Dec. 2010), 103-110.
Kim, Sungyoung, et al., "Virtual Ceiling Speaker: Elevating auditory imagery in a 5-channel reproduction", Convention Paper 7886. Proc. Audio Eng. Soc., presented at the 127th Convention, (Oct. 2009), 1-12.
Lee, K, et al., "Immersive Virtual Sound Beyond 5.1 Channel Audio", Convention Paper 8117. Proc. Audio Eng. Soc., presented at the128th Convention, (May 2010), 1-9.
Lee, Young Woo, et al., "Virtual Height Speaker Rendering for Samsung 10.2-channel Vertical Surround System", Convention Paper 8523.Proc. AES, presented at the 131st Convention, (Oct. 2011), 1-10.
Lopez, Jose, et al., "Experiments on the Perception of Elevated Sources in Wave-Field Synthesis using HRTF Cues", Convention Paper 8070. Proc. AES, 128th Convention, (May 2010), 1-14.
"U.S. Appl. No. 15/844,096, Final Office Action dated Sep. 29, 2020", 16 pgs.
"U.S. Appl. No. 15/844,096, Notice of Allowance dated Mar. 4, 2021", 9 pgs.
"U.S. Appl. No. 15/844,096, Notice of Allowance dated Dec. 9, 2020", 9 pgs.
"U.S. Appl. No. 15/844,096, Response filed Nov. 30, 2020 to Final Office Action dated Sep. 29, 2020", 13 pgs.
"Chinese Application Serial No. 201780090501.5, Office Action dated Jan. 5, 2021", with English translation, 33 pgs.
"European Application Serial No. 17900117.7, Extended European Search Report dated Nov. 6, 2020", 15 pgs.
"Korean Application Serial No. 10-2018-7035306, Office Action dated Mar. 31, 2021", with English translation, 11 pgs.

* cited by examiner

IMMERSIVE AUDIO REPRODUCTION SYSTEMS

CLAIM OF PRIORITY

This patent application is a Continuation of U.S. patent application Ser. No. 15/587,903, filed on May 5, 2017, which claims the benefit of priority to U.S. Provisional Patent Application No. 62/332,872, filed on May 6, 2016, the contents of which are incorporated by reference herein in their entireties.

BACKGROUND

Various techniques have been proposed for implementing audio signal processing based on Head-Related Transfer Functions (HRTF), such as for three-dimensional audio reproduction using headphones or loudspeakers. In some examples, the techniques are used for reproducing virtual loudspeakers localized in a horizontal plane, or located at an elevated position. To reduce horizontal localization artifacts for listener positions away from a "sweet spot" in a loudspeaker-based system, various filters can be applied to restrict the effect to lower frequencies. However, this can compromise an effectiveness of a virtual elevation effect.

Such techniques generally require or use an audio input signal that includes at least one dedicated channel intended for reproduction using an elevated loudspeaker. However, some commonly available audio content, including music recordings and movie soundtracks, may not include such a dedicated channel. Using a "pseudo-stereo" technique to spread an audio signal over two loudspeakers is generally insufficient or not suitable for producing a desired vertical immersion effect, for example, because it vertically elevates and expands the reproduced audio image globally. For a more natural-sounding immersion or enhancement effect, it is desirable to preserve the perceived localization of primary signal components (e.g., in the horizontal plane), while providing a perceived vertical expansion for ambient or diffuse signal components.

In an example, an upward-firing loudspeaker driver can be used to reflect height signals on a listening room's ceiling. This approach is not always practical, however, because it requires a horizontal ceiling at a moderate height, and calls for additional system complexity for calibration and relative delay alignment of height channel signals with respect to horizontal channel signals.

OVERVIEW

The present inventors have recognized that a problem to be solved includes providing an immersive, three-dimensional listening experience without requiring or using elevated loudspeakers. The problem can further include providing a virtual sound source in three-dimensional space relative to a listener, such as at a vertically elevated location, and at a specified angle relative to a direction in which the listener is facing. The problem can include tracking movement of the listener and correspondingly adjusting or maintaining the virtual sound source in the user's three-dimensional space. The problem can further include simplifying or reducing hardware requirements for reproducing three-dimensional or immersive sound field experiences.

In an example, a solution to the vertical localization problem includes systems and methods for immersive spatial audio reproduction. Embodiments can use loudspeakers to reproduce sounds perceived by listeners as coming at least in part from an elevated location, such as without requiring or using physically elevated or upward-firing loudspeakers. Various embodiments are compatible with or selected for specified audio playback devices including headphones, loudspeakers, and conventional stereo or surround sound playback systems. For example, some systems and methods described herein can be used for playback of enhanced, immersive three-dimensional multi-channel audio content such as using sound bar loudspeakers, home theater systems, or using TVs or laptop computers with integrated loudspeakers.

Besides the hardware simplification and cost savings from eliminating dedicated "height" loudspeakers or drivers, the present systems and methods include various advantages. For example, the signal processing methods can implement virtual height effects independently from horizontal-plane localization processing or rendering. This can permit optimization or tuning of the vertical and horizontal aspects separately, thereby preserving an elevation effect even at listening positions away from a "sweet spot" and independent of horizontal surround effect design compromises.

By removing dependencies between a virtual elevation effect and a horizontal-plane localization, efficient signal processing topologies can be enabled. In an example, the same or similar virtual height effect topology can be used whether a system includes only a two-channel stereo loudspeaker arrangement or the system includes additional loudspeakers, such as in a multi-channel surround sound system that includes front and rear loudspeakers. In an example, a multi-channel system example can use virtual rear elevation effects using the physical rear loudspeakers. In another example, a two-channel system example can use the virtual rear elevation effect in conjunction with a horizontal plane rear virtualization. The virtual height processing topology can be the same for both examples.

In an example, height upmixing techniques can be used to generate an enhanced immersion effect, such as for legacy content formats that may not include discrete height channels. The height upmix techniques can include vertically expanding a perceived localization of ambient components in input signals.

A solution to the above-described problems can include or use virtual height audio signal processing to deliver a more accurate and immersive sound field using conventional horizontal loudspeaker or headphone configurations. In an example, virtual height processing can apply a virtual height filter to audio signals intended for delivery using elevated loudspeakers. Such a virtual height filter can be derived from a head-related transfer function (HRTF) magnitude or power ratio characteristic. In some examples, the HRTF magnitude or power information can be derived independently of a desired azimuth localization angle relative to a listener's look or facing direction. The power ratio can be evaluated for a sound source located in a median plane in front of the listener. However, this approach may not address virtual height processing for sound localization away from the median plane.

In an example, virtual height processing can include or use a virtual height filter that is dependent, at least in part, on a specified azimuth, or rotational direction, of a virtual sound source relative to a listener's look direction. In an example, the processing can account for various differences between ipsilateral and contralateral HRTFs for elevated virtual sources.

In an example, a further solution to the above-described problems can include or use HRTF-based virtualization of phantom sources. Phantom sources can include audio information or sound signals that are amplitude-panned between multiple input or output channels, and such phantom sources are generally perceived by a listener as originating from somewhere between the loudspeakers. In an example, virtualization techniques, such as include frequency-domain spatial analysis and synthesis techniques, can be used for extracting and "re-rendering" phantom sound components at their respective proper or intended localizations, and decorrelation processing can be used together with virtualization to improve reproduction of phantom components, such as phantom center components.

In an example, a variable decorrelation effect can be incorporated in a pair of digital finite-impulse-response (FIR) HRTF filters.

In some examples, decorrelation processing can be applied exclusively to phantom-center sound components and no virtualization processing is applied to the decorrelated signals. In other examples, decorrelation processing can be incorporated within virtualization filters. In still other examples, the immersive spatial audio reproduction systems and methods described herein include or use virtualization of phantom sources, and decorrelation filters can be applied to input channel signals, such as prior to virtualization processing.

In an example, the immersive spatial audio reproduction systems and methods described herein can include or use low-complexity time-domain upmix processing techniques to generate an enhanced immersion effect, such as by vertically expanding a listener-perceived localization of ambient and/or diffuse components present in an input audio signal. The enhanced immersion effect can exhibit minimal or controlled effects on a localization of primary sound components. Upmix techniques can include passive or active matrices, the latter including frequency-domain algorithms (e.g., such as DTS® Neo:X™ and DTS® Neural: X™) that can derive synthetic height channels from legacy multi-channel content, such as from 5.1 surround sound content.

It should be noted that alternative embodiments are possible, and steps and elements discussed herein may be changed, added, or eliminated, depending on the particular embodiment. These alternative embodiments include alternative steps and alternative elements that may be used, and structural changes that may be made, without departing from the scope of the invention.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAIL ED DESCRIPTION

Figure 1:
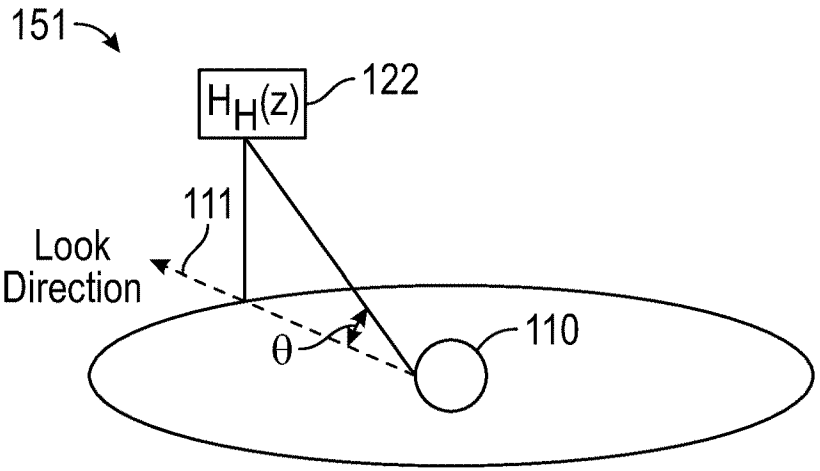
FIG. 1 illustrates generally first and second examples and of audio signal playback in a three-dimensional sound field.
Figure 1:
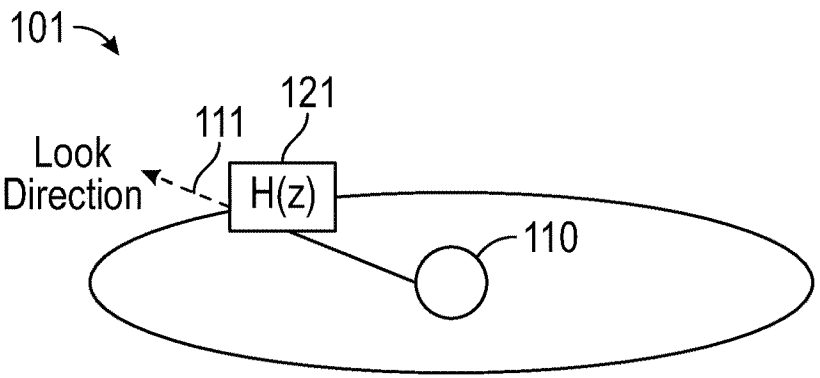

In the following description that includes examples of environment rendering and audio signal processing, such as for reproduction via headphones or other loudspeakers, reference is made to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. The present inventors contemplate examples using any combination or permutation of those elements shown or described (or one or more aspects thereof), either with respect to a particular example (or one or more aspects thereof), or with respect to other examples (or one or more aspects thereof) shown or described herein.

As used herein, the phrase "audio signal" is a signal that is representative of a physical sound. Audio processing systems and methods described herein can use or process audio signals using various filters. In some examples, the systems and methods can use signals from, or signals corresponding to, multiple audio channels. In an example, an audio signal can include a digital signal that includes information corresponding to multiple audio channels.

Various audio processing systems and methods can be used to reproduce two-channel or multi-channel audio signals over various loudspeaker configurations. For example, audio signals can be reproduced over headphones, over a pair of bookshelf loudspeakers, or over a surround sound system, such as using loudspeakers positioned at various locations with respect to a listener. Some examples can include or use compelling spatial enhancement effects to enhance a listening experience, such as where a number or orientation of loudspeakers is limited.

In U.S. Pat. No. 8,000,485, to Walsh et al., entitled "Virtual Audio Processing for Loudspeaker or Headphone Playback", which is hereby incorporated by reference in its entirety, audio signals can be processed with a virtualizer processor to create virtualized channel signals that can be summed with other signals to produce a modified stereo image. Additionally or alternatively to the techniques in the '485 patent, the present inventors have recognized that virtual height processing can be used to deliver an accurate sound field representation that includes vertical components while using horizontally-arranged loudspeaker configurations.

In an example, relative virtual elevation filters, such as can be derived from head-related transfer functions, can be applied to render virtual audio information that is perceived by a listener as including sound information at various specified altitudes or elevations above or below a listener to further enhance a listener's experience. In an example, such virtual audio information is reproduced using a loudspeaker provided in a horizontal plane and the virtual audio information is perceived to originate from a loudspeaker or other source that is elevated relative to the horizontal plane, such as even when no physical or real loudspeaker exists in the perceived origination location. In an example, the virtual audio information provides an impression of sound elevation, or an auditory illusion, that extends from, and optionally includes, audio information in the horizontal plane.

FIG. 1 illustrates generally first and second examples 101 and 151 of audio signal playback in a three-dimensional sound field. In the first example 101, a listener 110 faces a first direction 111, or "look direction." In the example, the look direction extends along a first plane associated with the listener 110. In some examples, the first plane includes a horizontal plane that coincides with the ears of the listener 110, or with the torso of the listener 110, or with a waist of the listener 110. The first plane, in other words, can be referenced to a specified orientation or location relative to the listener 110.

FIG. 1 illustrates a virtual height processing filter from a first head-related transfer function (HRTF) filter H(z), such as can be measured at a first position 121 in a median plane relative to a head of the listener 110. That is, in an example, the first position 121 can have a 0 degree azimuth angle in a horizontal, front direction with respect to the listener 110.

In the second example 151, the listener 110 faces the first direction 111, and a second virtual height processing filter from a second head-related transfer function (HRTF) filter $H_H(z)$ can be measured at a second position 122 relative to a head of the listener 110. In this example, the second position 122 is provided at an elevated position in the median plane. That is, the second position 122 can have a 0 degree azimuth angle and a non-zero altitude angle θ in a horizontal, front direction with respect to the listener 110.

In the first example 101, an audio input signal, denoted X in Equation (1), below, can be provided by a loudspeaker at the first position 121 in the median plane. A signal Y received at the left or right ear of the listener 110 can be expressed as:

$$Y(z)=H(z)X(z) \tag{1}$$

In the second example 151, a signal $Y_H$ received at the left or right ear of the listener 110 can be expressed as:

$$Y_H(z)=H_H(z)X(z) \tag{2}$$

A listener's perception that signal X emanates or originates from the second position 122 while using a loudspeaker located at the first position 121 can be provided by ensuring that the reproduced audio signal, as received by the listener 110, has substantially the same magnitude spectrum as signal $Y_H$. Such a signal can be obtained by pre-filtering the input signal X with a virtual height filter $E_H$, to thereby yield a modified loudspeaker input signal X' and a received signal Y' such that:

$$|Y'(z)|=|H(z)|\ |X'(z)|=|H(z)|\ |E_H(z)X(z) \tag{3}$$

and $$|H(z)|\ |E_H(z)X(z)|=|H(z)|\ |E_H(z)|\ |X(z)| \tag{4}$$

In an example, a magnitude spectrum |Y'(z)| can be made substantially equal to $|Y_H(z)|$ for any input signal X, such as when the magnitude transfer function $|E_H(z)|$ of the virtual height filter satisfies Equation (5).

$$|H(z)|\ |E_H(z)|=|H_H(z) \tag{5}$$

In an example, the virtual height filter $E_H(z)$ can be designed as a minimum-phase filter or as a linear-phase filter whose magnitude transfer function $|E_H(z)|$ is substantially equal to the magnitude spectral ratio of the HRTF filters $H_H(z)$ and H(z), as shown in Equation 6.

$$|E_H(z)|=|H_H(z)|/|H(z)| \tag{6}$$

When a minimum-phase design is used, the virtual height filter $E_H(z)$ can be defined as shown in Equation 7.

$$E_H(z)=\{H_H(z)\}\ \{H(z)\}^{-1} \tag{7}$$

In Equation (7), and throughout this discussion, {G(z)} denotes a minimum-phase transfer function having magnitude equal to |G(z)|, such as for any transfer function G(z).

Figure 2:
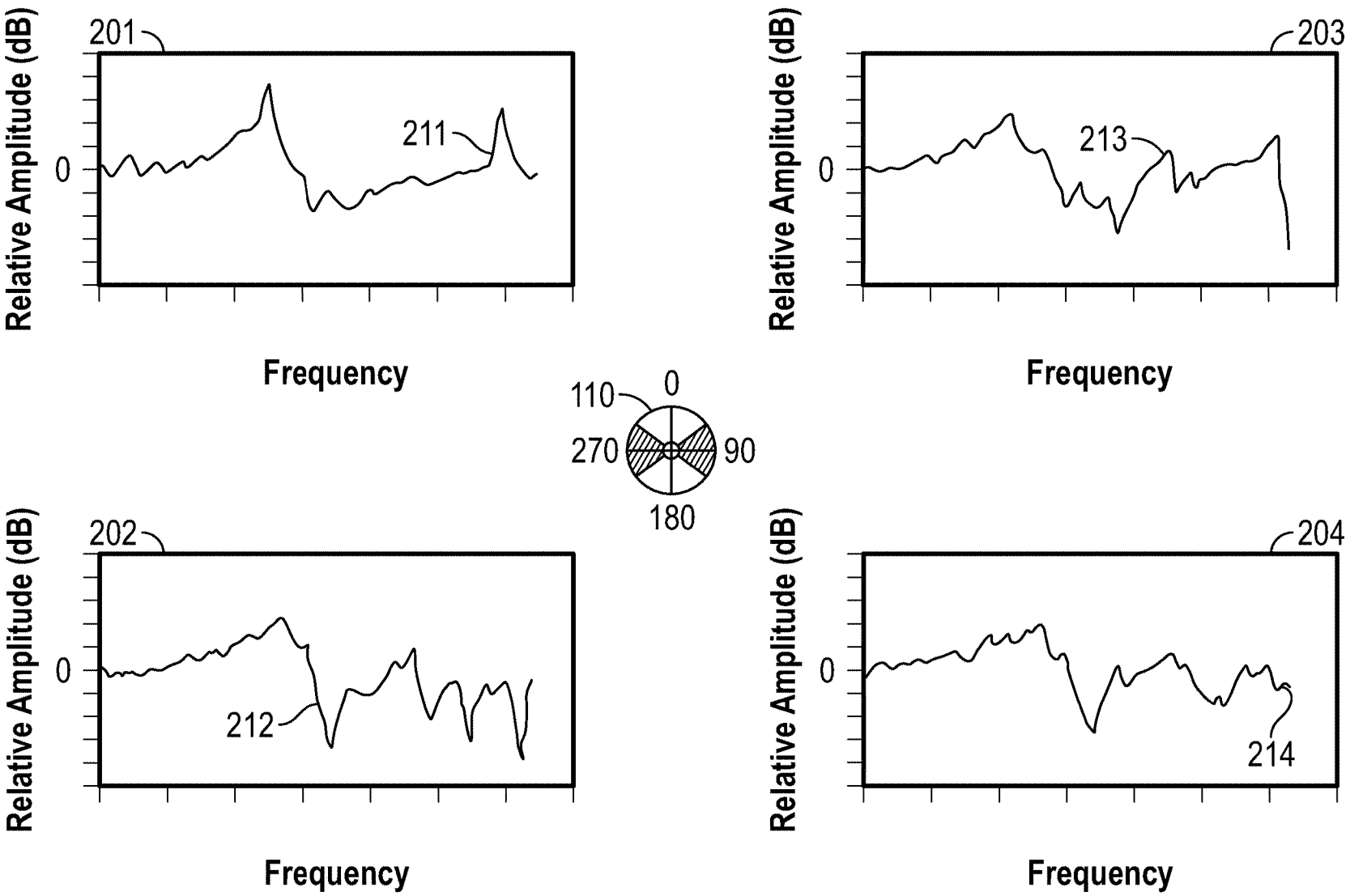
FIG. 2 illustrates an example of multiple ipsilateral and contralateral elevation spectral response charts.

FIG. 2 illustrates an example of multiple elevation spectral response charts. Each of the illustrated charts shows HRTF spectral ratio information, wherein the x axis represents frequency and the y axis represents a relative amplitude ratio expressed in decibels. The spectral ratio information is for a sound source located at 45 degrees elevation and various azimuth angles (φ) or positions, including ipsilateral front and back positions, and contralateral front and back positions. For example, FIG. 2 includes a first chart 201 that shows a first trace 211 that indicates a frequency vs. relative amplitude ratio relationship for an ipsilateral front position of the listener 110. That is, the first chart 201 indicates that different frequency-specific HRTF filter characteristics can be used when a height or elevation of the source is fixed (e.g., at 45 degrees) and the source is intended to be perceived as originating or including information from an ipsilateral front position. A second chart 202 shows a second trace 212 that indicates a frequency vs. relative amplitude ratio relationship for an ipsilateral back or rear position of the listener 110. Third and fourth charts 203 and 204 similarly show third and fourth traces 213 and 214 that indicate frequency vs. relative amplitude ratio relationship for contralateral front and contralateral back positions of the listener 110, respectively.

From the example of FIG. 2, the HRTF magnitude ratio (e.g., elevation spectral cue) changes with the azimuth angle (φ) or position. Therefore, rather than keeping a virtual height filter constant, such as regardless of an azimuth angle (φ), an effective or accurate virtual height effect can be provided using a virtual height filter that depends at least in part on a specified azimuth angle (φ). In an example, the virtual height filter can be independent of a horizontal-plane sound spatialization method used, such as to more closely match a measured elevation spectral cue for a given azimuth angle (φ).

Figure 3:
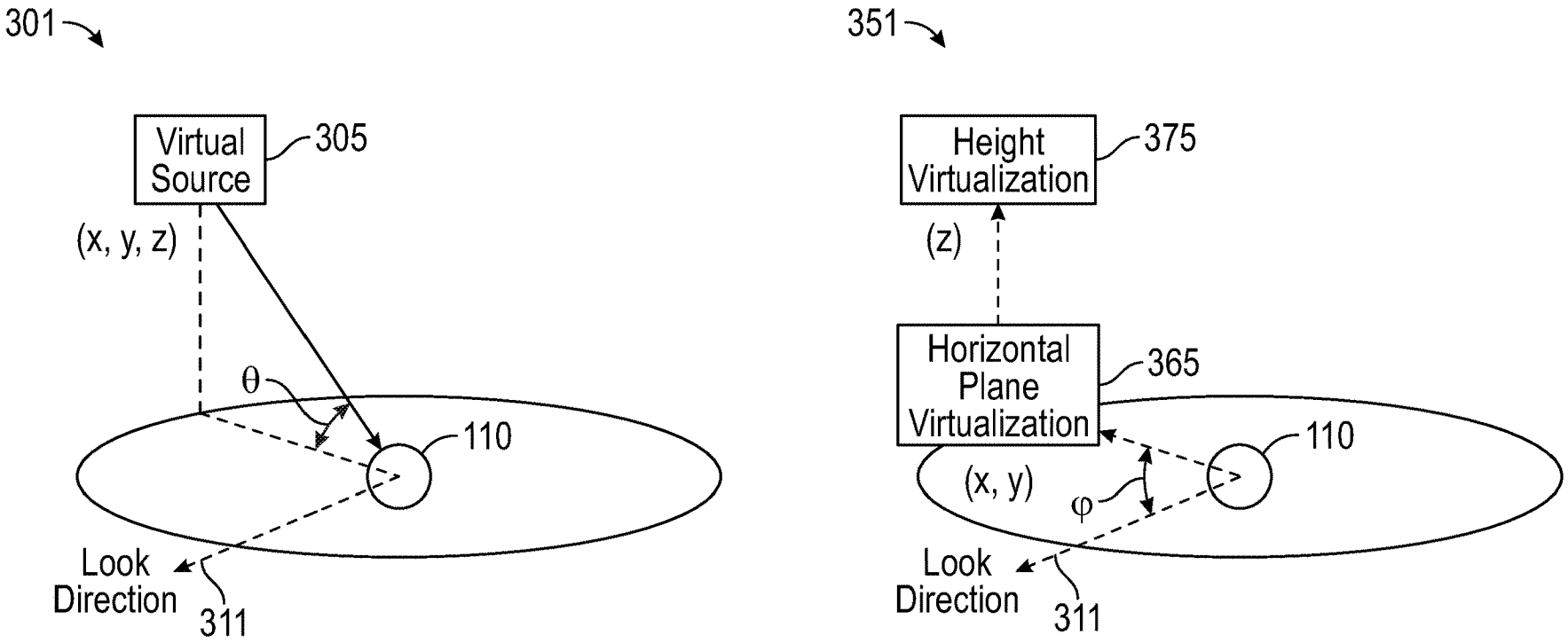
FIG. 3 illustrates generally first and second examples and of virtual height and horizontal plane sound signal spatialization.

FIG. 3 illustrates generally first and second examples 301 and 351 of virtual height and horizontal plane sound signal processing or spatialization. Such spatialization can include, for instance, amplitude panning, Ambisonics, and HRTF-based virtual loudspeaker processing techniques. Properly applied, these techniques can be used to approximate signals that would be received at the ipsilateral and contralateral sides of the listener 110, such as if the input signal X was played from a loudspeaker located in the soundfield at an azimuth angle φ and at an altitude angle θ.

In the first example 301, the listener 110 can face or look in a second direction 311 in a three-dimensional soundfield. A virtual source 305 located in the soundfield can be provided at coordinates (x, y, z) in a three-dimensional sound field, such as where the listener 110 is located at the origin of the field. A localization problem can include determining which of multiple available processing or spatialization techniques to use or apply to the input signal X such that the listener 110 perceives the reproduced signal as originating from the virtual source 305.

The second example 351 illustrates generally an example of a solution to the localization problem that includes providing a virtual sound source. The second example 351 includes the same listener 110 facing in the second direction 311. To provide an auditory illusion of an elevated sound source, such as located at a non-zero azimuth angle φ and at a non-zero altitude angle θ, such as outside of the median plane, the second example 351 can include pre-filtering, such as using the virtual height filter $E_H(z)$ of Equation (6) to apply horizontal-plane sound spatialization. In the example of FIG. 3, the audio input signal can be first processed, such as using an audio processor circuit, using a Horizontal Plane Virtualization module 365 to virtualize or provide a horizontally-located signal at coordinates (x, y). The horizontally-located signal can then be further processed, such as using the same or different audio processor circuit including a Height Virtualization module 375 to virtualize or provide a vertically-located signal at a distance z from the horizontally-located signal. That is, in an example, an audio processor circuit can be used to generate a virtualized or localized height audio signal such as by applying signal filters (e.g., HRTF-based filters) to one or more source signals. Although FIG. 3 depicts the vertically-located signal as being elevated relative to the plane of the listener 110, the vertically-located signal could alternatively or additionally be lowered relative to the plane of the listener 110.

Figure 4:
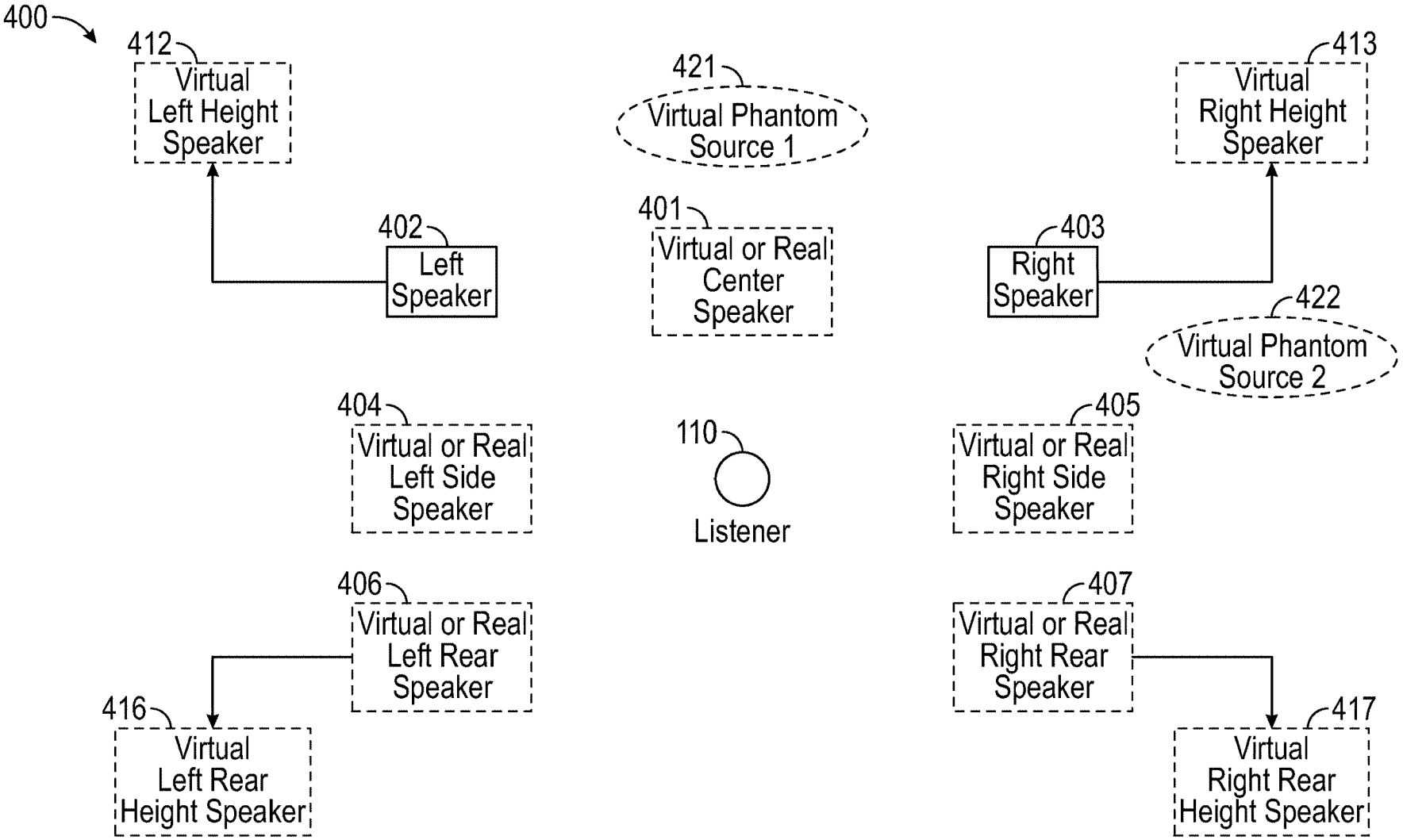
FIG. 4 illustrates generally an example of a system that uses multiple virtual height loudspeakers to simulate an 11.1 playback system.

Virtualization techniques described herein can be used or applied to simulate different playback system configurations. FIG. 4, for example, illustrates generally an example of a system 400 that can include or use multiple virtual height loudspeakers to simulate an 11.1 surround sound playback system. For example, the system 400 can include a 7.1 horizontal surround sound playback system with four virtual height loudspeakers to provide or simulate an 11.1 (or 7.1.4) playback system for the listener 110. In the example of the system 400, the horizontal surround sound playback system includes at least a center speaker 401, left front speaker 402, right front speaker 403, left side speaker 404, right side speaker 405, left rear speaker 406, and right rear speaker 407. In an example, any one or more of the speakers in the system 400 are virtualized except for the left front speaker 402 and the right front speaker 403.

In the example of FIG. 4, the system 400 includes a virtual left front height speaker 412, a virtual right front height speaker 413, a virtual left rear height speaker 416, and a virtual right rear height speaker 417. In an example, each virtual height loudspeaker can be provided using a horizontal-plane physical loudspeaker or horizontal-plane virtual loudspeaker having the same or similar azimuth angle, and that receives for reproduction a signal that is pre-filtered with a virtual height filter that is configured to simulate the elevation spectral cue calculated for the specified azimuth angle (see, e.g., the charts 201-204 from the example of FIG. 2 showing examples of different elevation spectral cues). In an example, a magnitude transfer function of a virtual height filter for each azimuth angle can be calculated by power averaging of the ipsilateral and contralateral HRTFs prior to computing the spectral magnitude or power ratio at each frequency.

Figure 5:
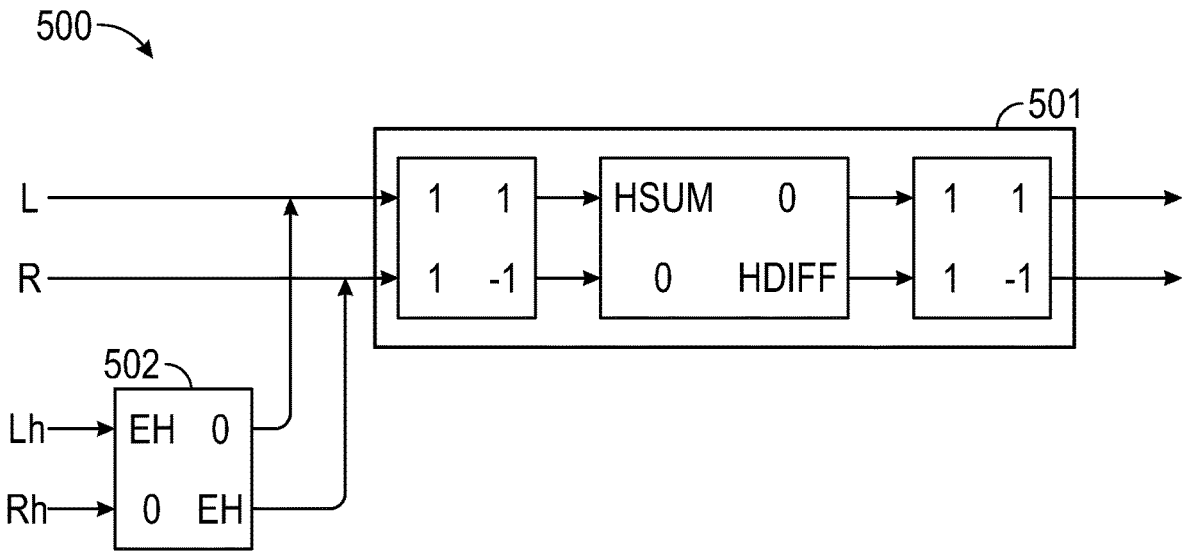
FIG. 5 illustrates generally an example of a virtualizer processing system, according to some embodiments.

FIG. 5 illustrates generally an example of a virtualizer processing system 500, according to some embodiments. In the example, the virtualizer processing system 500 includes a horizontal-plane virtualizer circuit 501 (e.g., corresponding to the Horizontal Plane Virtualization module 365) configured to receive a horizontal audio signal input pair (signals designated L and R) and provide an output pair, such as to a corresponding pair of output loudspeaker drivers or to an amplifier circuit. The system 500 further includes a height virtualizer circuit 502 (e.g., corresponding to the Height Virtualization module 375) configured to receive a height audio signal input pair (signals designated Lh and Rh).

In the example of the system 500, the horizontal-plane virtualizer circuit 501 provides horizontal-plane spatialization to the audio signal input pair (L, R). In an example, the horizontal-plane virtualizer circuit 501 is realized using a "transaural" shuffler filter topology that assumes that the L and R virtual loudspeakers are symmetrically located relative to the median plane, as well as to the two output loudspeaker drivers. Under this assumption, the sum and difference virtualization filters can be designed according to Equations 8 and 9:

$$H_{SUM}=\{H_i+H_c\}\ \{H_{0i}+H_{0c}\}^{-1} \tag{8}$$

$$H_{DIFF}=\{H_i-H_c\}\ \{H_{0i}-H_{0c}\}^{-1} \tag{9}$$

In Equations 8 and 9, dependence on the frequency variable z is omitted for simplification, and the following HRTF notations are used:

$H_{0i}$: ipsilateral HRTF for a left or right physical loudspeaker location;

$H_{0c}$: contralateral HRTF for a left or right physical loudspeaker location;

$H_i$: ipsilateral HRTF for a left or right virtual loudspeaker location; and $H_c$: contralateral HRTF for a left or right virtual loudspeaker location.

In an example, by replacing in Equations (8) and (9) the horizontal HRTF pair ($H_i$; $H_c$) with a height HRTF pair (e.g., $H_{Hi}$ and $H_{Hc}$, wherein $H_{Hi}$ is an ipsilateral HRTF for the left or right virtual height loudspeaker locations, and $H_{Hc}$ is a contralateral HRTF for the left or right virtual height loudspeaker locations), the same virtualizer processing system 500 topology can be used to simulate or virtualize height loudspeakers in order to reproduce the height channel signals Lh and Rh.

In some examples, virtual height loudspeakers can be simulated as shown in FIG. 5 using pre-processing of the height audio signal input pair signals Lh and Rh with the virtual height filter $E_H$, such as prior to horizontal-plane virtualization processing. In an example, this approach can be advantageous because it can help reduce a computational load on the system 500, such as by sharing a single horizontal virtualization processing block for the audio signal input pair (L, R) and the height audio signal input pair (Lh, Rh). In an example, pre-processing the height audio signal input pair signals can help preserve a subjective effectiveness of the virtual height filter, such as independently of the filter design optimizations that may be applied by the horizontal plane virtualizer circuit 501.

In an example, the elevation filter $E_H$ can be incorporated directly within the sum and difference filter pair ($H_{SUM}$; $H_{DIFF}$) by replacing it with ($E_H H_{SUM}$; $E_H H_{DIFF}$). Therefore, in a virtualizer design where $H_{SUM}$ and $H_{DIFF}$ are band-limited to lower frequencies, or otherwise modified from Equations (8) and (9), an effectiveness of the virtual height effect can be independently controlled.

Figure 6:
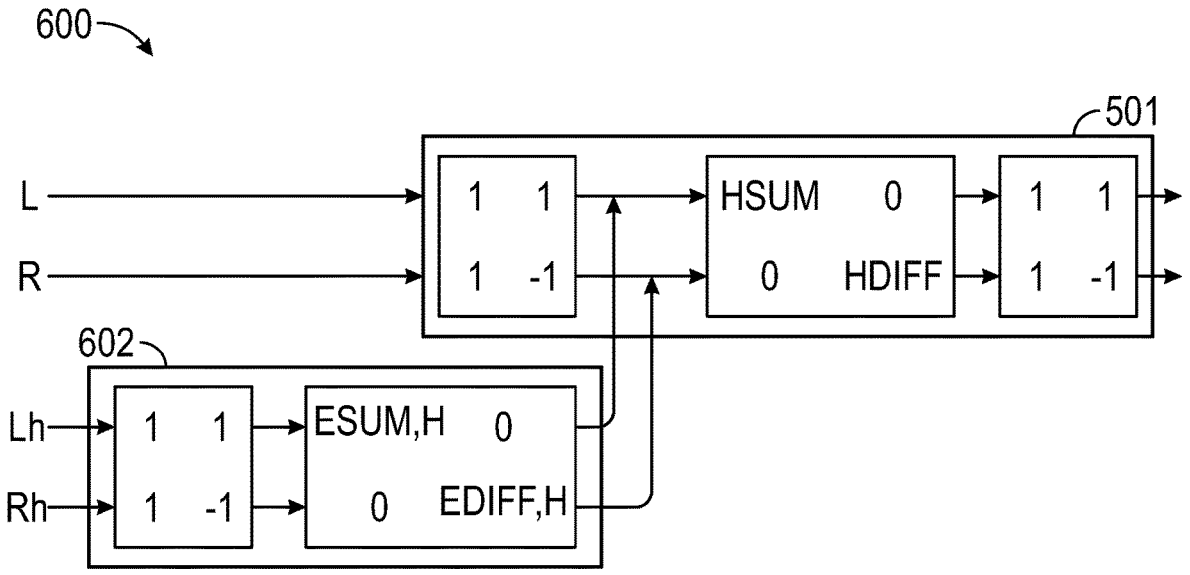
FIG. 6 illustrates generally an example of a second virtualizer processing system, according to some embodiments.

FIG. 6 illustrates generally an example of a second virtualizer processing system 600, according to some embodiments. In the example, the second virtualizer processing system 600 includes the horizontal-plane virtualizer circuit 501, such as configured to receive a horizontal audio signal input pair (signals designated L and R) and provide an output pair, such as to a corresponding pair of output loudspeaker drivers or to respective channels in an amplifier circuit. The system 600 further includes a second height virtualizer circuit 602 configured to receive a height audio signal input pair (e.g., signals designated Lh and Rh).

In the example of FIG. 6, the second virtualizer processing system 600 can be configured to differentiate reproduction of ipsilateral and contralateral elevation spectral cues. In this example, the virtual height loudspeaker signals Lh and Rh can be assumed to be symmetrically located relative to the median plane, and the second height virtualizer circuit 602 includes a sum filter and a difference filter, wherein:

$$E_{SUM,H}=\{H_{Hi}+H_{Hc}\}\ \{H_i+H_c\}^{-1} \tag{10}$$

$$E_{DIFF,H}=\{H_{Hi}-H_{Hc}\}\ \{H_i-H_c\}^{-1} \tag{11}$$

In other examples for virtual loudspeaker processing, virtual height processing can be incorporated directly within the sum and difference filter pair ($H_{SUM}$; $H_{DIFF}$) such as by replacing it with ($E_{SUM,H}\ H_{SUM}$; $E_{DIFF,H}\ H_{DIFF}$). Thus in a system where $H_{SUM}$ and $H_{DIFF}$ are band-limited to lower frequencies or otherwise modified from Equations (8) and (9), an effectiveness of a virtual height effect can be independently controlled.

In an example, virtual height processing can be applied to multi-channel signals. Multi-channel audio signals can include sound components that are "panned" across two or more audio channels in order to provide sound localizations that do not coincide with static or physical loudspeaker positions. Such panned sounds can be referred to as "phantom sources".

Referring again to FIG. 4, the system 400 illustrates first and second virtual phantom sources 421 and 422. In an example, an input signal panned between the front left and right height input channels provides the first virtual phantom source 421. When these input channels are reproduced as virtual loudspeakers, the perceived result is referred to as a virtual phantom source. Similarly, the second virtual phantom source 422 can represent a localization such as after virtual loudspeaker processing for a phantom source panned between the front right height and rear right height input channels.

Even when virtual loudspeaker processing faithfully reproduces localization effects of each input channel signal auditioned individually, it can be observed that a rendering of virtual phantom sources can suffer audible degradation in localization, loudness or timbre when combined with other corresponding audio program material. For example, a perceived localization of the first virtual phantom source 421 can be less elevated than expected, such as compared to the virtual left front height speaker 412 and the virtual right front height speaker 413. In some examples, this degradation issue can be mitigated by applying inter-channel decorrelation processing, such as prior to virtualization processing.

Figure 7:
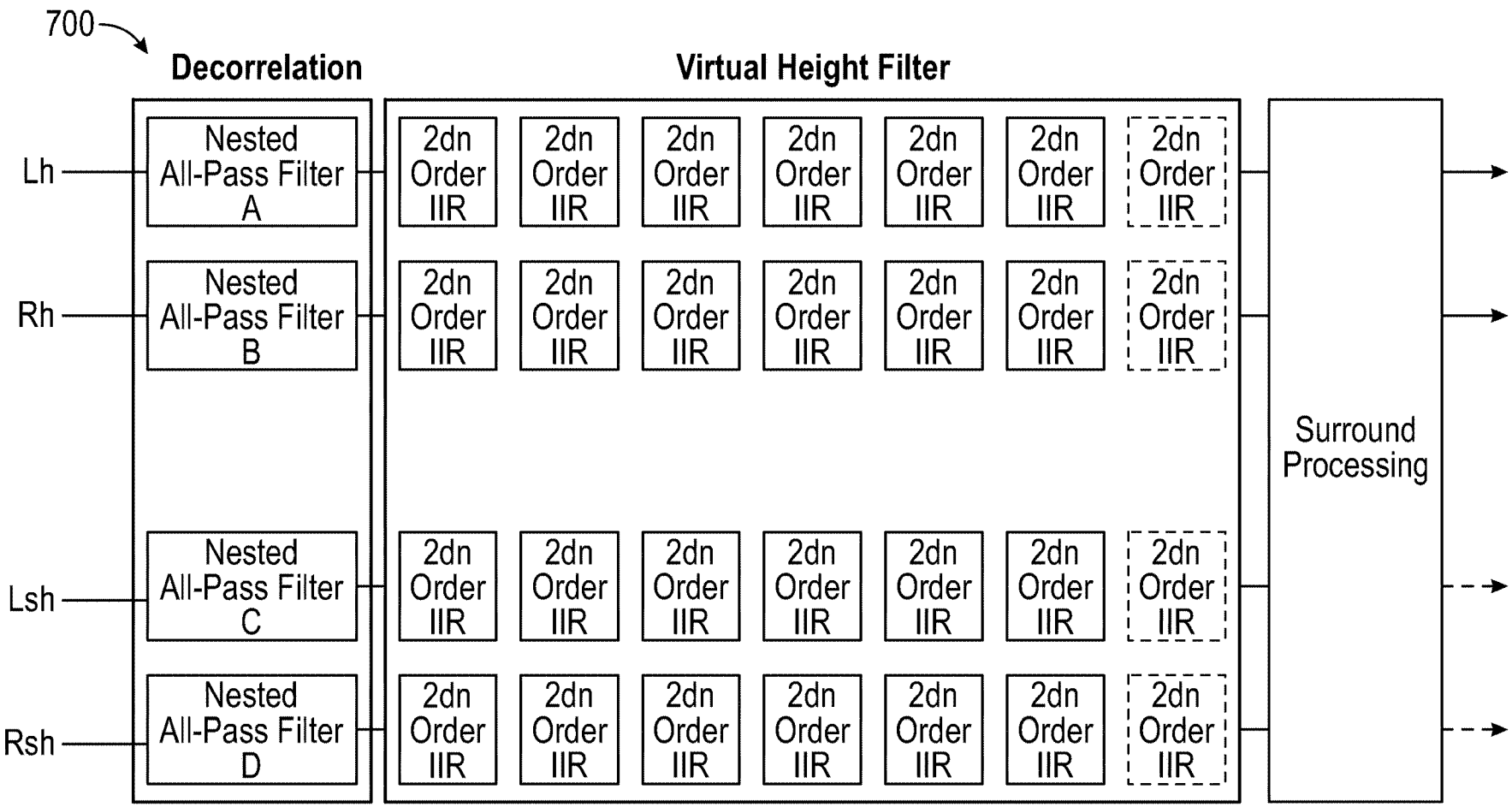
FIG. 7 illustrates generally an example of a block diagram of a portion of a system for virtual height processing.

FIG. 7 illustrates generally an example of a block diagram of a portion of a system 700 for virtual height processing. In an example, the system 700 is configured to receive a 4-channel input signal comprising a front height input signal pair (Lh, Rh) and a rear or side height input signal pair (Lsh, Rsh). The system includes a Decorrelation module configured to apply a decorrelation filter to each of the input signals separately. In an example, the Decorrelation module applies a respective different all-pass filter to each of the input signals, and the each of the filters can be differently configured.

Decorrelation is an audio processing technique that reduces a correlation between two or more audio signals or channels. In some examples, decorrelation can be used to modify a listener's perceived spatial imagery of an audio signal. Other examples of using decorrelation processing to adjust or modify spatial imagery or perception can include decreasing a perceived "phantom" source effect between a pair of audio channels, widening a perceived distance between a pair of audio channels, improving a perceived externalization of an audio signal when it is reproduced over headphones, and/or increasing a perceived diffuseness in a reproduced sound field.

In an example, a method for reducing correlation between two (or more) audio signals includes randomizing a phase of each audio signal. For example, respective all-pass filters, such as each based upon different random phase calculations in the frequency domain, can be used to filter each audio signal. In some examples, decorrelation can introduce timbral changes or other unintended artifacts into the audio signals.

In the example of FIG. 7, the various input signals can receive decorrelation processing prior to virtualization, that is, prior to being subjected to any virtual height filters or spatial localization processing. After decorrelation processing, the input signals (e.g., source signals panned between the Lh and Rh input channels) can be made to be heard by the listener at virtual positions substantially located on the shortest arc centered on the listener's position and joining the due positions of the virtual loudspeakers. The present inventors have recognized that such decorrelation processing can be effective in helping to avoid various virtual localization artifacts, such as in-head localization, front-back confusion, and elevation errors, such as can detract from a listener's experience.

Figure 8:
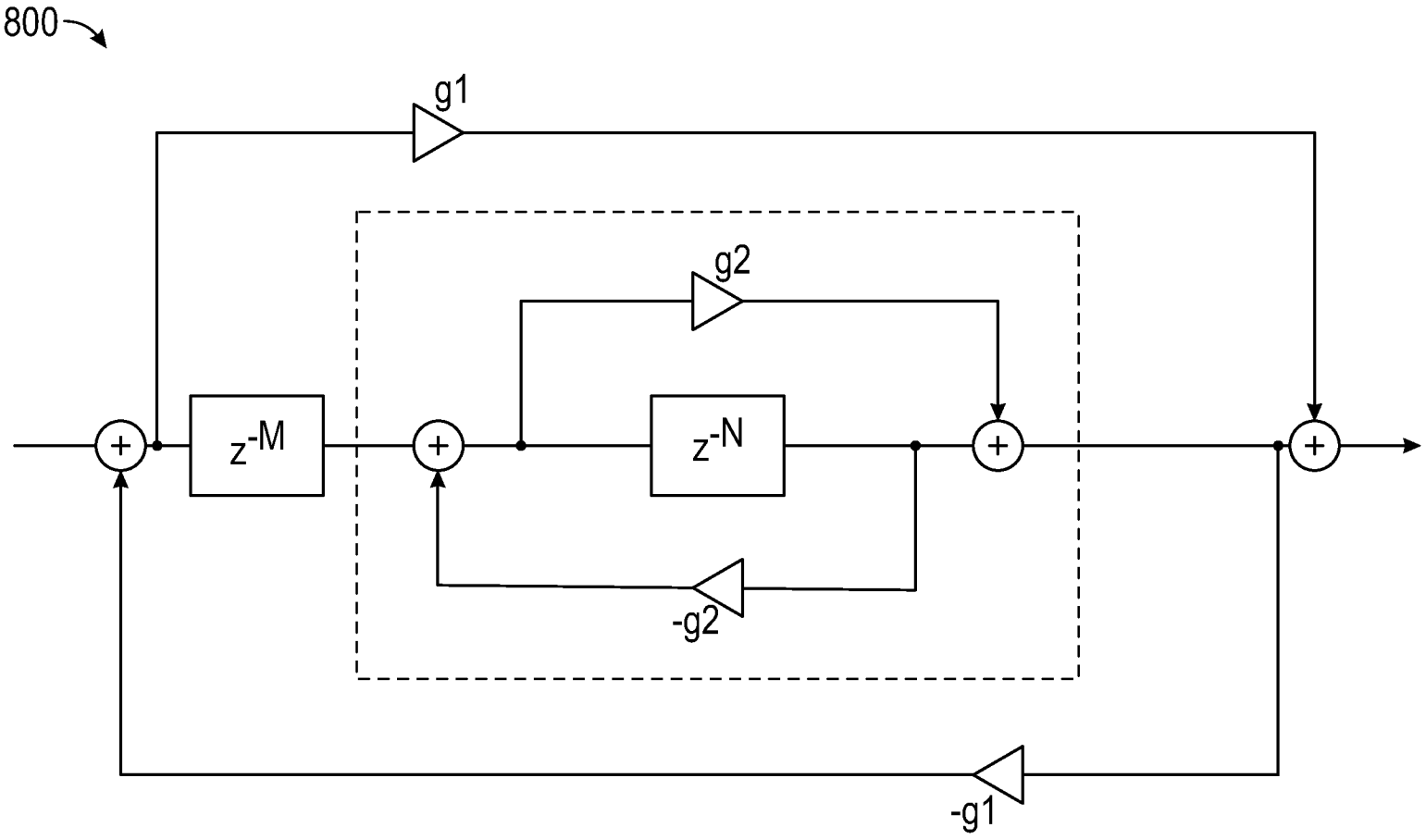
FIG. 8 illustrates generally an example of a block diagram of a nested all-pass filter.

FIG. 8 illustrates generally an example of a block diagram of a nested all-pass filter 800. Filter parameters M, N, g1, and g2 influence a decorrelation effect of the filter 800, such as relative to other signals processed using other filters or using another instance of the filter 800 with different parameters. In an example, each decorrelation filter from the system 700 of FIG. 7 includes an instance of the nested all-pass filter 800 from the example of FIG. 8.

In an example, inter-channel decorrelation can be obtained by choosing different values for the parameters M, N, g1 and g2 of each nested all-pass filter (as represented by different letters A, B, C, and D in the example of FIG. 7). Other decorrelation filter types or techniques can similarly be used in the Decorrelation block of the system 700.

Referring again to FIG. 7, the system 700 further includes a Virtual Height Filter module. In the Virtual Height Filter module, a respective virtual height filter can be applied to each of the four input signals (Lh, Rh, Lsh, Rsh). In the example, each filter is modeled as a series or cascade of second-order digital IIR filter sections. Other digital filter implementations can be based on specified magnitude or frequency response characteristics and can be used for virtual height filters. In the example of FIG. 7, a Surround Processing module follows the Virtual Height Filter module. In an example, the Surround Processing module includes a front-channel horizontal-plane virtualizer applied to the front height input signal pair (Lh, Rh) (see, e.g., FIG. 5), and a rear-channel horizontal-plane virtualizer applied to the rear height input signal pair (Lsh, Rsh).

Figure 9:
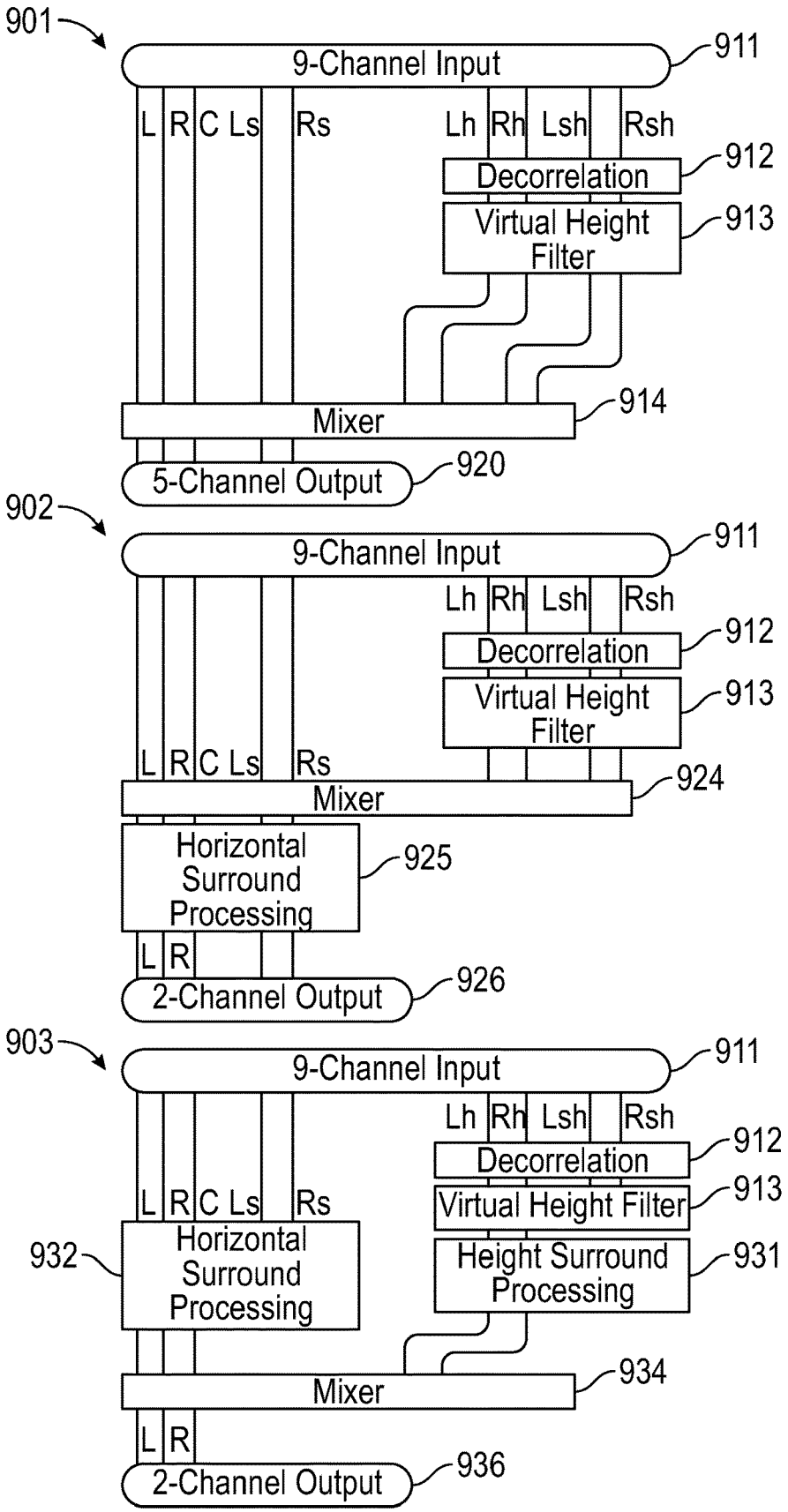
FIG. 9 illustrates generally first, second, and third examples of a virtual height processor in a 9-channel input system.

FIG. 9 illustrates generally first, second, and third examples 901, 902, and 903, of a virtual height processor in a 9-channel input system. The first example 901 includes a signal flow diagram showing a 9-channel input signal 911 that includes signal components or channels L, R, C, Ls, Rs, Lh, Rh, Lsh, and Rsh. Various hardware circuitry can be used to receive the 9-channel input signal 911, such as including discrete electrical or optical input paths to receive time-varying audio signal information at an audio processor circuit.

In an example, one or more of the signal components or channels includes metadata (e.g., analog or digital data encoded with audio signal information) with information about a localization for one or more of the same or other signal components or channels. For example, the left height channel Lh and the right height channel Rh can include respective data or information about a specified localization of the audio content included therein. In an example, the localization information can be provided via other means, such as using a separate or dedicated hardware input to an audio processor circuit. The localization information can include an indication as to which channel(s) the localization information corresponds. In an example, the localization information includes azimuth and/or altitude information. The altitude information can include an indication of a localization that is above or below a reference plane.

In the first example 901, height-channel input signals Lh, Rh, Lsh, and Rsh are provided to a Decorrelation module 912 where one or more of the four input signals is subjected to a decorrelation filter. In an example, each of the four input signals is subject to a decorrelation filter that includes or uses a nested all-pass filter, such as the filter 800 of FIG. 8. In an example, each of the four input signals is subjected to a different instance of the decorrelation filter and different decorrelation filter parameters are used for each instance. The Decorrelation module 912 can include or use other circuits (e.g., high pass, low pass, or other filters) to decorrelate the input signals.

Following decorrelation processing by the Decorrelation module 912, resulting decorrelated signals are provided to a Virtual Height Filter module 913. In an example, the Virtual Height Filter module 913 includes or uses the Height Virtualization module 375 from the example of FIG. 3 and applies signal processing or filtering to the one or more decorrelated signals to provide a virtualized height audio information signal. At the Virtual Height Filter module 913, a front virtual height filter can be selected and applied to the height audio signal input pair (Lh, Rh), such as described above in the discussion of FIG. 5. In an example, the front virtual height filter is selected using a processor circuit to retrieve an appropriate filter based on an azimuth parameter associated with the input signal(s). In an example, a rear virtual height filter can be applied to the rear height input signal pair (Lsh, Rsh). In some examples, the front and rear virtual height filters can be based on azimuth angle-specific HRTF data, such as can be measured relative to the direction of the C-channel (e.g., front center) speaker. Following the Virtual Height Filter module 913, filtered signals can be provided to a Mixer module 914, and the filtered height signals Lh, Rh, Lsh and Rsh can be down-mixed into the corresponding horizontal input signal (respectively L, R, Ls and Rs) to produce a 5-channel output signal 920. That is, the Mixer module 914 can provide means or hardware for combining or summing one or more components of a virtualized height audio information signal (e.g., from the virtual height filter 913) with one or more other signals (e.g., from the 9-channel input signal 911) that are configured or desired to be concurrently reproduced. In an example, the 5-channel output signal 920 can be configured for use in audio reproduction using loudspeakers in a first plane of a listener to produce audible information that is perceived by the listener as including information outside of the first plane, for example, above or below the first plane.

The second example 902 of FIG. 9 includes a signal flow diagram showing the 9-channel input signal 911 that includes signal components or channels L, R, C, Ls, Rs, Lh, Rh, Lsh, and Rsh. In the second example 902, the height-channel input signals Lh, Rh, Lsh, and Rsh are provided to the Decorrelation module 912 and to the Virtual Height Filter module 913, similarly to the first example 901. Following the Virtual Height Filter module 913, filtered signals can be provided to a Mixer module 924, and the filtered height signals Lh, Rh, Lsh and Rsh can be down-mixed into the corresponding horizontal input signal (respectively L, R, Ls and Rs) to produce a 5-channel output signal. In the second example 902, the 5-channel output signal can be further processed by a Horizontal Surround Processing module 925 configured to provide a two-channel loudspeaker output signal 926. The two-channel output signal 926 can be configured for use in audio reproduction using loudspeakers in a first plane of a listener to produce audible information that is perceived by the listener as including information outside of the first plane, for example, above or below the first plane. In some examples, the Surround Processing module 925 includes a front-channel horizontal-plane virtualizer applied to a front signal pair (L, R), such as shown in FIG. 5, and a rear-channel horizontal-plane virtualizer applied to a side signal pair (Ls, Rs) In an example, the Horizontal Surround Processing module 925 can include or use the Horizontal Plane Virtualization module 365 from the example of FIG. 3 to virtualize or provide horizontally-located signal components.

The third example 903 of the example of FIG. 9 includes a signal flow diagram showing the 9-channel input signal 911 that includes signal components or channels L, R, C, Ls, Rs, Lh, Rh, Lsh, and Rsh. In the third example 903, the height-channel input signals Lh, Rh, Lsh, and Rsh are provided to the Decorrelation module 912 and the Virtual Height Filter module 913, similarly to the first example 901.

In an example, the Virtual Height Filter module 913 can be configured to down-mix the filtered signals to a signal pair and provide the signals to a Height Surround Processing module 931. Horizontal input signals L, R, C, Ls, and Rs, can be separately processed using a Horizontal Surround Processing module 932. In an example, the Horizontal Surround Processing module 932 can include or use the Horizontal Plane Virtualization module 365 from the example of FIG. 3 to virtualize or provide horizontally-located signal components. Outputs from the Height Surround Processing module 931 and the Horizontal Surround Processing module 932 can be provided to a Mixer module 934 that is configured to further mix the signals and provide a two-channel loudspeaker output signal 936. In an example, the two-channel output signal 936 can be configured for use in audio reproduction using loudspeakers in a first plane of a listener to produce audible information that is perceived by the listener as including information outside of the first plane, for example, above or below the first plane.

In an example, an input signal intended for presentation or reproduction using a loudspeaker in a horizontal plane can be modified to derive an output signal that is to be provided to a real or virtual height speaker. Such input signal processing can be referred to as height upmixing or height upmix processing.

Figure 10:
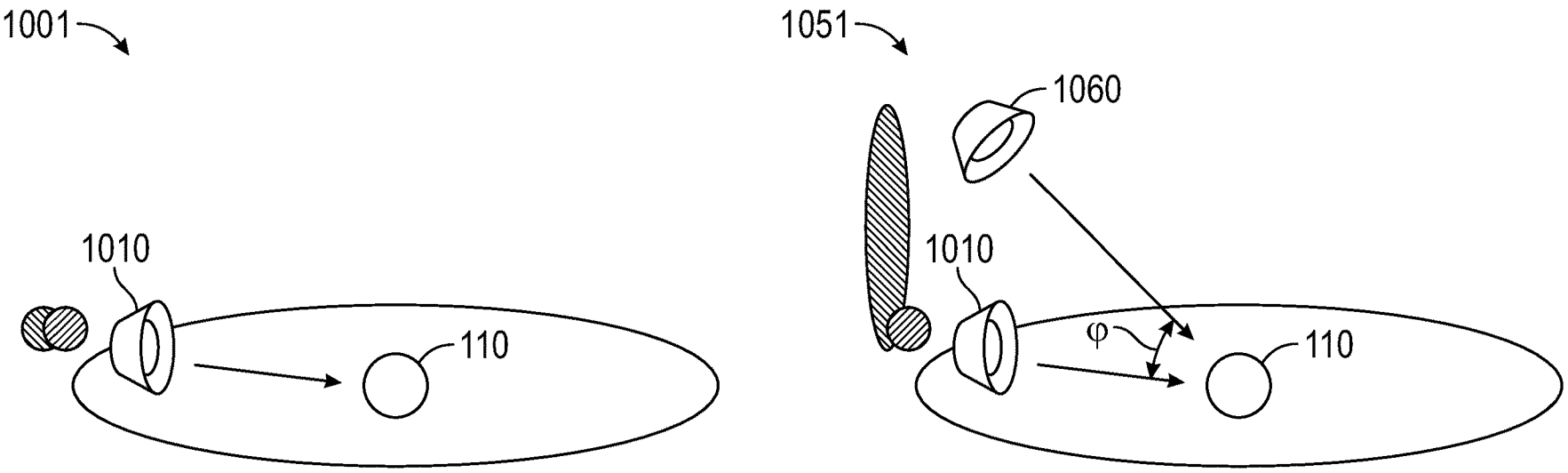
FIG. 10 illustrates generally an example of height upmix processing.

FIG. 10 illustrates generally an example of height upmix processing. FIG. 10 includes a first example 1001 wherein an apparent sound source location 1010 is spaced from the listener 110. In an example, an intended effect of height upmix processing is to vertically expand a perceived extent of diffuse sounds, such as while maintaining a perceived sound source localization, such as in a horizontal plane. FIG. 10 further includes a second example 1051 wherein the apparent sound source location 1010 remains at substantially the same azimuth angle but with an apparent vertical extension of diffuse sounds to provide a signal for a height speaker location 1060.

Figure 11:
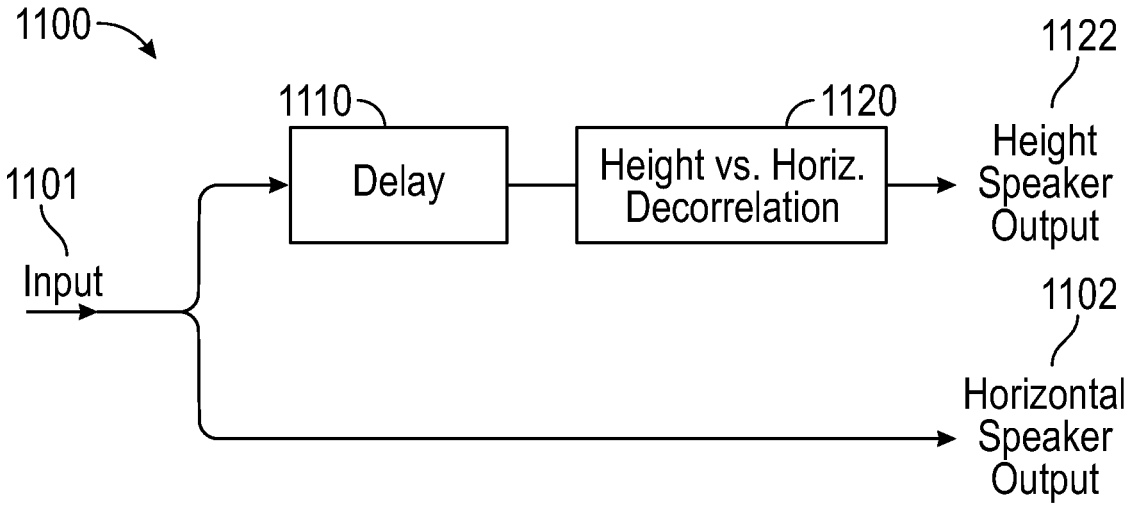
FIG. 11 illustrates generally a block diagram of height upmix processing for a single channel input signal.

FIG. 11 illustrates generally a block diagram 1100 of height upmix processing for a single channel input signal 1101. The input signal 1101 can be divided into a horizontal-path signal and a height-path signal. In an example, the horizontal-path signal can be passed to a horizontal speaker output 1102. The height-path signal can be received at a Delay module 1110. After a specified delay duration is applied to the height-path signal, the delayed signal can be provided from the Delay module 1110 to a Decorrelation module 1120. The delay duration can be adjustable. Typical delay duration values can be in a range of about 5 to 20 milliseconds to leverage the psycho-acoustic Haas Effect (a.k.a. "law of the first wave front"), such as to ensure that perceived sound source localizations for transient input signals are maintained in the horizontal speaker (see, e.g., FIG. 10). Other delay duration values can similarly be used.

For quasi-stationary signals having low auto-correlation, such as reverberation decay tails, an effect of the height upmix processing technique of FIG. 11 can be to expand the perceived sound localization upward from the horizontal plane. In some examples, such as shown in FIG. 11, the Decorrelation module 1120 can apply a decorrelation filter to the height-path signal (and additionally or alternatively, to the horizontal-path signal) to further reduce correlation between signals at the height speaker output 1122 and at the horizontal speaker output 1102. Such further decorrelation can enhance the perception or sensation of vertical extension.

Figure 12:
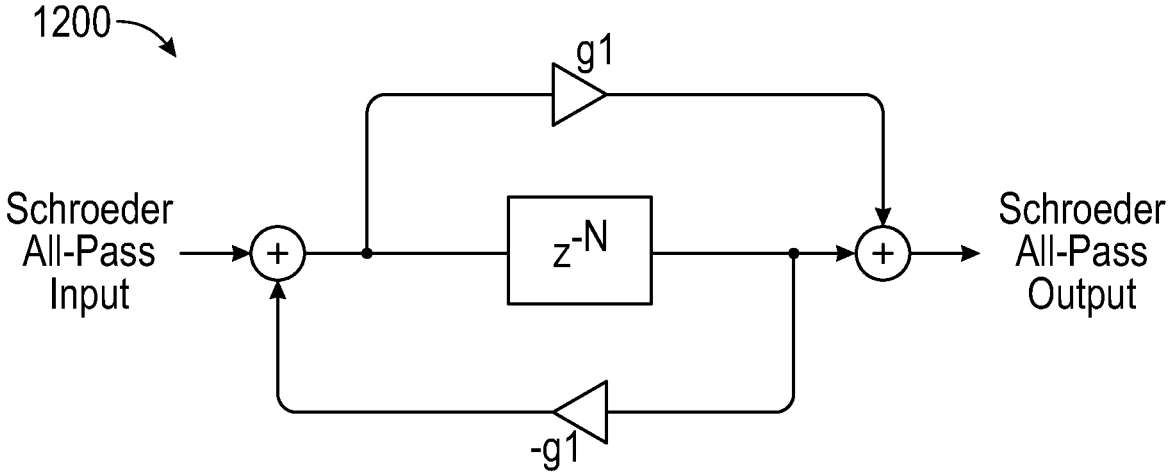
FIG. 12 illustrates generally a block diagram of an example of the Decorrelation module from the example of FIG. 11.

FIG. 12 illustrates generally a block diagram of an example of the Decorrelation module 1120 from the example of FIG. 11. In this example, the decorrelation filter includes a Schroeder all-pass section 1200. The filter can have various adjustable parameters, including a delay of length M, and a feedback gain $g_1$ having magnitude less than 1. In an example, values for each of the magnitude of the feedback gain $g_1$ and for the delay length can be about 0 to 10 milliseconds. Other values can similarly be used.

Some examples of systems that can perform virtual height upmixing are illustrated in FIGS. 13-16. In the examples, a horizontal channel input signal can be divided into multiple signal paths, including a height-path signal and a horizontal-path signal, similarly to the example of FIG. 11. The height-path signal can be forwarded to a virtual height filter and then combined with an unprocessed, minimally processed, or decorrelated version of the horizontal-path signal, such as prior to optional horizontal-plane virtualization of the signal.

Figure 13:
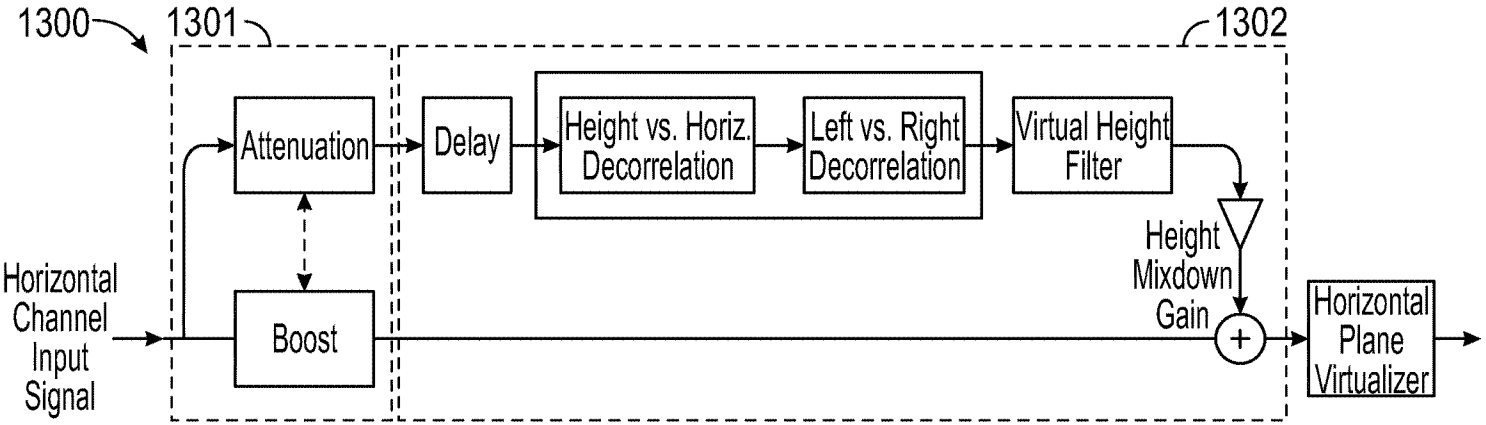
FIG. 13 illustrates generally a first height upmix processing example.

FIG. 13 illustrates generally a first height upmix processing example 1300. The example 1300 includes a first input signal processing circuit 1301 and an upmix processing circuit 1302. The first input signal processing circuit 1301 is configured to receive a horizontal channel input signal and divide the signal to provide a height-path signal to an attenuation circuit (e.g., a parametric low-frequency shelving attenuator circuit) and to provide a horizontal-path signal to a boost circuit (e.g., a parametric low-frequency shelving boost circuit). In an example, the attenuation and boost circuits can be quasi-complementary meaning that an attenuation characteristic provided by the attenuator circuit can be opposed by a boost characteristic provided by the boost circuit. In an example, the attenuation and boost characteristics can have substantially equal but opposite values, however, unequal values can similarly be used. Outputs from the first signal processing circuit 1301 can be provided to the upmix processing circuit 1302.

In the upmix processing circuit 1302, an attenuated signal from the attenuation circuit can be delayed using a delay circuit, and then further processed using a Decorrelation module. In an example, the Decorrelation module decorrelates left and right channel signal components, decorrelates height and horizontal channel signal components, or decorrelates other signal components. Following decorrelation, the resulting decorrelated signals can be processed using a virtual height filter and then mixed with the boosted horizontal-path signal from the boost circuit. The mixed signals can be optionally provided to a horizontal-plane virtualizer circuit for further processing, such as before being output to an amplifier, subsequent processor module, or loudspeaker.

In the example 1300 of FIG. 13, the Decorrelation module's left/right and height/horizontal filter components can be combined into a single decorrelation filter that can be realized, for example, using an all-pass filter, such as using the nested all-pass filter 800 from the example of FIG. 8. In an example, the Decorrelation module can be helpful for mitigating timbre artifacts or sound coloration artifacts (sometimes referred to as "comb-filter" coloration) that can result from down-mixing a delayed height-path signal with an un-delayed horizontal-path signal.

In an example, comb-filter coloration can be further mitigated by attenuating a height-path signal at lower frequencies, such as using a shelving equalization filter (e.g., using the attenuation circuit). A boost shelving filter can be applied (e.g., using the boost circuit) to the horizontal-path signal to help preserve an overall signal loudness characteristic of the final combined output signal. Additionally, to preserve equal power across all signal frequencies, it can be helpful for the mix-down gain to be 0 dB, and for the attenuation and boost of the complementary shelving filters to be set to opposite-polarity values (e.g., +3 dB and −3 dB).

Figure 14:
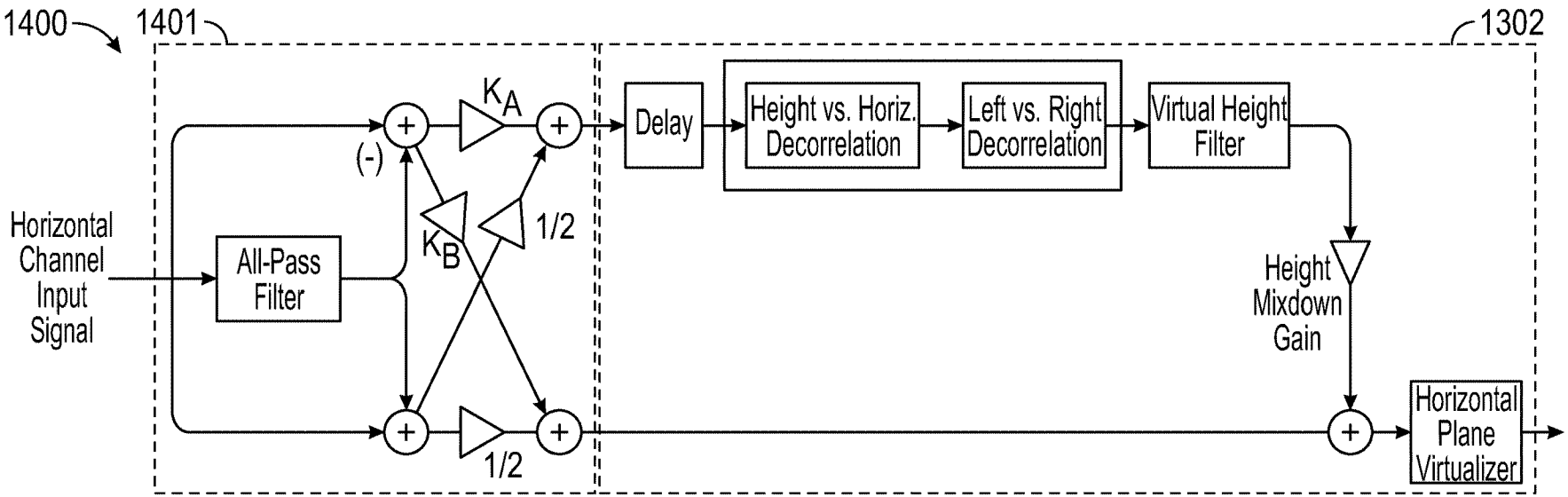
FIG. 14 illustrates generally a second height upmix processing example.

FIG. 14 illustrates generally a second height upmix processing example 1400. The example 1400 includes a second input signal processing circuit 1401 and the same upmix processing circuit 1302 from the example 1300 of FIG. 13. In an example, one or more parameters of the upmix processing circuit 1302 can be changed to accommodate signals from the second input signal processing circuit 1401. In the example 1400, the quasi-complementary attenuation and boost circuits from the first input signal processing circuit 1301 can be replaced with a single, all-pass filter and signal sum and difference operators. Sum and difference signals can be obtained between the input signal and the output of a first order or second order all-pass filter applied to the same input signal. To achieve attenuation and boost shelving effects, subsequent sums of the previous difference can be multiplied by attenuation and boost coefficients $K_A$ and $K_B$, respectively, and a previous sum can be divided by a factor of two.

Figure 15:
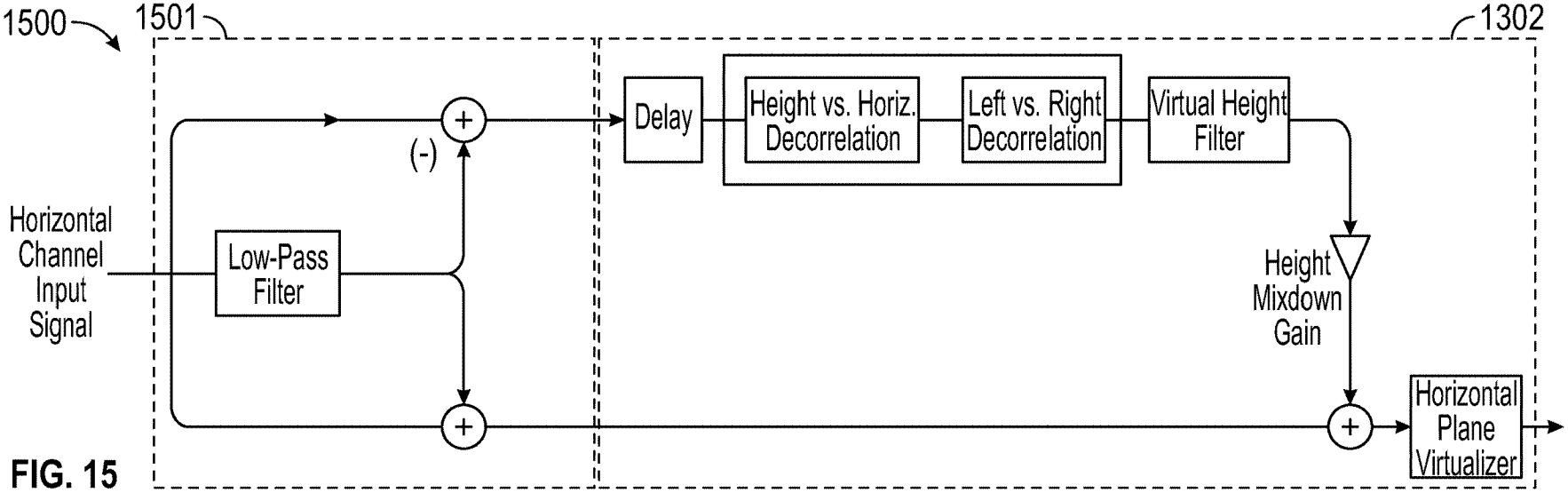
FIG. 15 illustrates generally a third height upmix processing example.

FIG. 15 illustrates generally a third height upmix processing example 1500. The example 1500 includes a third input signal processing circuit 1501 and the same upmix processing circuit 1302 from the example 1300 of FIG. 13. In an example, one or more parameters of the upmix processing circuit 1302 can be changed to accommodate signals from the third input signal processing circuit 1501. In the example 1500, the quasi-complementary attenuation and boost circuits from the first input signal processing circuit 1301 can be replaced with a single low-pass filter and sum and difference operators. In the example 1500, a sum and difference can be obtained between the input signal and the output of the low-pass filter applied to the same input signal.

Figure 16:
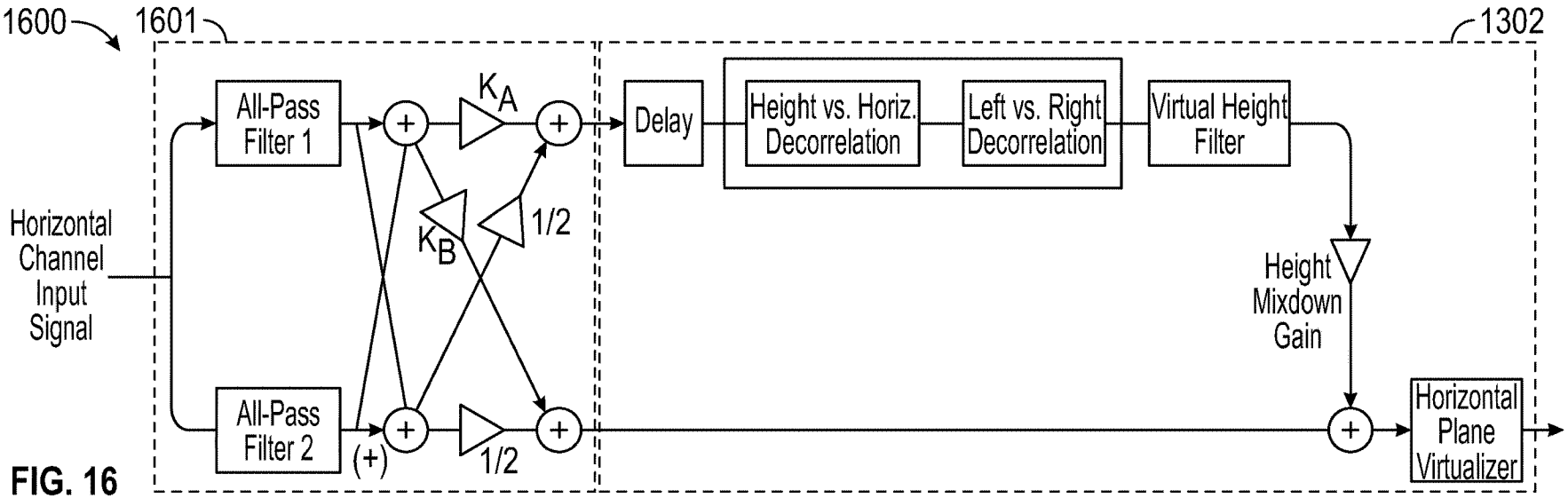
FIG. 16 illustrates generally a fourth height upmix processing example.

FIG. 16 illustrates generally a fourth height upmix processing example 1600. The example 1600 includes a fourth input signal processing circuit 1601 and the same upmix processing circuit 1302 from the example 1300 of FIG. 13. In an example, one or more parameters of the upmix processing circuit 1302 can be changed to accommodate signals from the fourth input signal processing circuit 1601. In the example 1600, the quasi-complementary attenuation and boost circuits from the first input signal processing circuit 1301 can be implemented using a parallel combination of all-pass filters ("All-pass Filter 1" and "All-pass Filter 2") followed by sum and difference operators. Sum and difference signals can be obtained between an output of All-pass Filter 1 and an output of All-pass Filter 2. To attain attenuation and boost shelving effects, subsequent sums of the previous difference multiplied by attenuation and boost coefficients $K_A$ and $K_B$, respectively, can be applied, and a previous sum can be divided by a factor of two.

Figure 17:
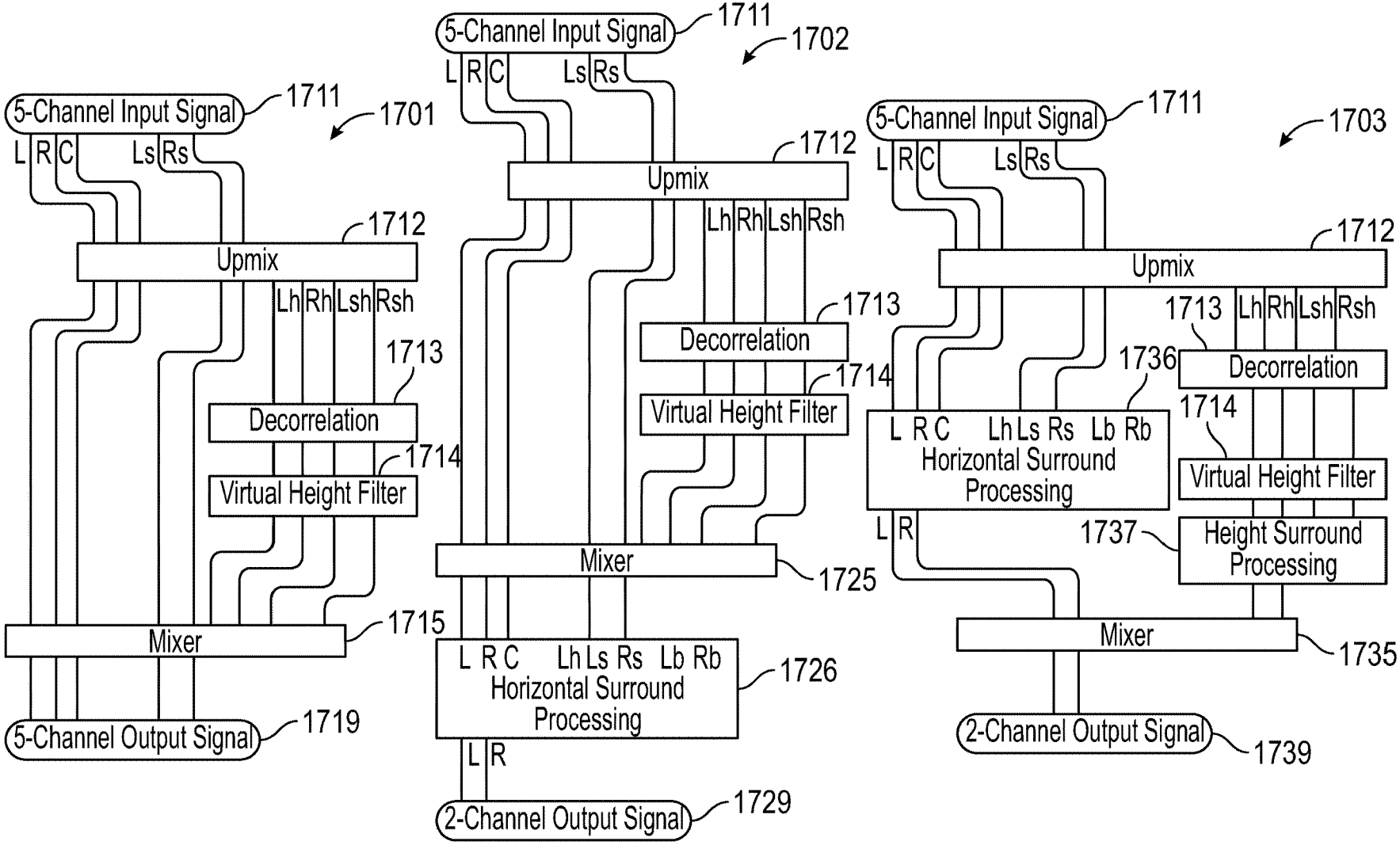
FIG. 17 illustrates generally first, second, and third examples of a virtual height upmix processor in a 5-channel input system.

FIG. 17 illustrates generally first, second, and third examples 1701, 1702, and 1703, of a virtual height upmix processor in a 5-channel input system. The first example 1701 includes a signal flow diagram showing a 5-channel input signal 1711 that includes signal components or channels L, R, C, Ls, and Rs. Various hardware circuitry can be used to receive the 5-channel input signal 1711, such as including discrete electrical or optical input paths to receive time-varying audio signal information at an audio processor circuit.

In an example, one or more of the signal components or channels includes metadata (e.g., analog or digital data encoded with audio signal information) with information about a localization for one or more of the same or other signal components or channels. In an example, the localization information can be provided via other means, such as using a separate or dedicated hardware input to an audio processor circuit. The localization information can include an indication as to which channel(s) the localization information corresponds. In an example, the localization information includes azimuth and/or altitude information. The altitude information can include an indication of a localization that is above or below a reference plane.

In the first example 1701, the input signals are provided to an Upmix Processor module 1712 that generates height signals Lh, Rh, Lsh, and Rsh, such as based on information in the input signals. The Upmix Processor module 1712 can include or use any of the systems shown in the first through fourth height upmix processing examples 1300, 1400, 1500, and 1600, from the examples of FIGS. 13, 14, 15, and 16 respectively. For example, the Upmix Processor module 1712 can be configured to split each input channel into a height-path signal to which a delay can be applied, and a horizontal-path signal, such as with quasi-complementary low-frequency attenuation and boost. In an example, the Upmix Processor module 1712 can further be configured to pass the input signal 1711 (L, R, C, Ls, and Rs) to a first Mixer module 1715.

In the first example 1701, the four height signals generated by the Upmix Processor module 1712 can be provided to a Decorrelation module 1713, and at least one or more of the four input signals can be subjected to a decorrelation filter. In an example, each of the four input signals can be subjected to a decorrelation filter that includes or uses a unique instance of a nested all-pass filter, such as the filter 800 of FIG. 8. Other hardware filters or circuits can similarly be used or applied to generate decorrelated signals, such as using a phase-shift or time-delay audio filter circuit. Following decorrelation processing by the Decorrelation module 1713, resulting decorrelated signals are provided to a Virtual Height Filter module 1714. In an example, the Virtual Height Filter module 1714 includes or uses the Height Virtualization module 375 from the example of FIG. 3 and applies signal processing or filtering to the one or more decorrelated signals.

At the Virtual Height Filter module 1714, a front virtual height filter can be applied to the height audio signal input pair (Lh, Rh), such as described above in the discussion of FIG. 5, such as using an audio processor circuit. In an example, a rear virtual height filter can be applied to the rear height input signal pair (Lsh, Rsh). In some examples, the front and rear virtual height filters can be selected based on or using azimuth angle-specific HRTF data, such as can be measured relative to a direction of a C-channel (e.g., front center channel) speaker. In an example, the Virtual Height Filter module 1714 and/or audio processor circuit generates a virtualized audio signal by filtering the height audio signal input(s).

Following the Virtual Height Filter module 1714, filtered signals can be provided to the Mixer module 1715, and the filtered height signals Lh, Rh, Lsh, and Rsh, can be downmixed by the Mixer module 1715 into the corresponding horizontal path signals (L, R, C, Ls and Rs) to produce a 5-channel output signal 1719. The 5-channel output signal 1719 can be configured for use in audio reproduction using loudspeakers in a first plane of a listener to produce audible information that is perceived by the listener as including information outside of the first plane, for example, above or below the first plane.

The second example 1702 illustrates a variation of the first example 1701 that includes horizontal surround processing. The second example 1702 can include a Horizontal Surround Processing module 1726 configured to receive the 5-channel output signal from a Mixer module 1725, and provide a down-mixed 2-channel output signal 1729 (e.g., a left and right stereo pair). The 2-channel output signal 1729 can be configured for use in audio reproduction using loudspeakers in a first plane of a listener to produce audible information that is perceived by the listener as including information outside of the first plane, for example, above or below the first plane.

In an example, the Horizontal Surround Processing module 1726 can include or use the Horizontal Plane Virtualization module 365 from the example of FIG. 3 to virtualize or provide horizontally-located signal components. In an example, the Horizontal Surround Processing module 1726 includes a front-channel horizontal-plane virtualizer applied to the left and right front signal pair (L, R), such as illustrated in the example of FIG. 5, and a rear-channel horizontal-plane virtualizer applied to the left and right side signal pair (Ls, Rs).

The third example 1703 illustrates a variation of the first example 1701 that includes separately applied height surround processing and horizontal surround processing. The third example 1703 can include a Horizontal Surround Processing module 1736 configured to receive the 5-channel output signal from the Upmix Processor module 1712 and provide a down-mixed 2-channel output signal (e.g., a left and right stereo pair) to a Mixer module 1735. In an example, the Horizontal Surround Processing module 1736 can include or use the Horizontal Plane Virtualization module 365 from the example of FIG. 3 to virtualize or provide horizontally-located signal components. In an example, the Horizontal Surround Processing module 1736 includes a front-channel horizontal-plane virtualizer applied to the left and right front signal pair (L, R), such as illustrated in the example of FIG. 5, and a rear-channel horizontal-plane virtualizer applied to the left and right side signal pair (Ls, Rs).

The third example 1703 can include a Height Surround Processing module 1737 configured to receive output signals Lh, Rh, Lsh, and Rsh, from the Virtual Height Filter module 1714. The Height Surround Processing module 1737 can further process and down-mix the four height signals from the Virtual Height Filter module 1714 to provide a down-mixed 2-channel output signal (e.g., a left and tight stereo pair). The respective 2-channel output signals from the Horizontal Surround Processing module 1736 and from the Height Surround Processing module 1737 can be combined by a Mixer module 1735 to render a two-channel loudspeaker output signal 1739. The 2-channel output signal 1739 can be configured for use in audio reproduction using loudspeakers in a first plane of a listener to produce audible information that is perceived by the listener as including information outside of the first plane, for example, above or below the first plane.

Various systems and machines can be configured to perform or carry out one or more of the signal processing tasks described herein. For example, any one or more of the Upmix modules, Decorrelation modules, Virtual Height Filter modules, Height Surround Processing modules, Horizontal Surround Processing modules, Mixer modules, or other modules or processes, such as provided in the examples of FIGS. 9 and 17, can be implemented using a general purpose or special, purpose-built machine that performs the various processing tasks, such as using instructions retrieved from a tangible, non-transitory, processor-readable medium.

Figure 18:
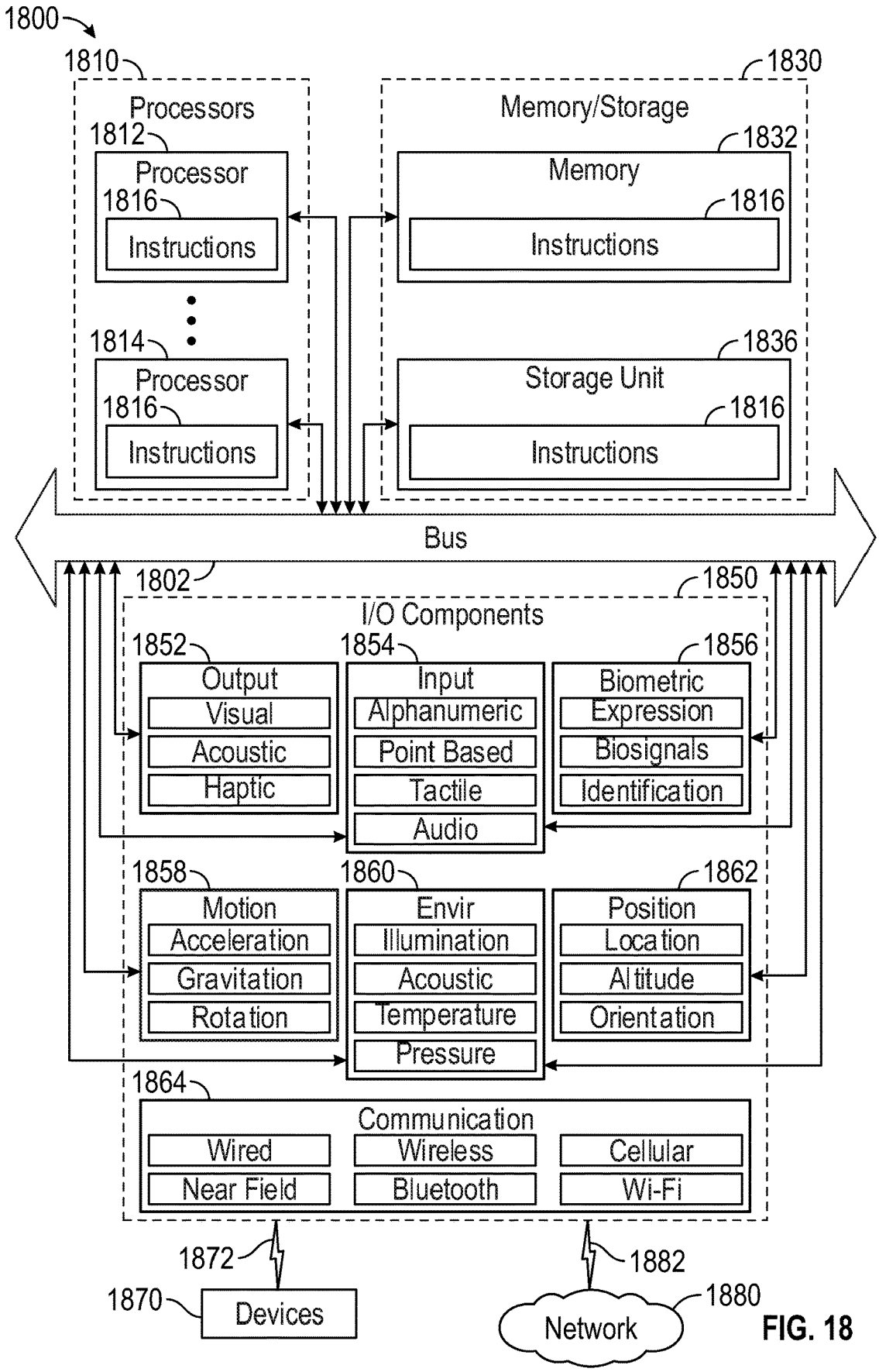
FIG. 18 is a block diagram illustrating components of a machine that is configurable to perform any one or more of the methodologies discussed herein.

FIG. 18 is a block diagram illustrating components of a machine 1800, according to some example embodiments, able to read instructions 1816 from a machine-readable medium (e.g., a machine-readable storage medium) and perform any one or more of the methodologies discussed herein. Specifically, FIG. 18 shows a diagrammatic representation of the machine 1800 in the example form of a computer system, within which the instructions 1816 (e.g., software, a program, an application, an applet, an app, or other executable code) for causing the machine 1800 to perform any one or more of the methodologies discussed herein may be executed. For example, the instructions 1816 can implement modules or circuits or components of FIGS. 5-7, and FIGS. 11-17, and so forth. The instructions 1816 can transform the general, non-programmed machine 1800 into a particular machine programmed to carry out the described and illustrated functions in the manner described (e.g., as an audio processor circuit). In alternative embodiments, the machine 1800 operates as a standalone device or can be coupled (e.g., networked) to other machines. In a networked deployment, the machine 1800 can operate in the capacity of a server machine or a client machine in a server-client network environment, or as a peer machine in a peer-to-peer (or distributed) network environment.

The machine 1800 can comprise, but is not limited to, a server computer, a client computer, a personal computer (PC), a tablet computer, a laptop computer, a netbook, a set-top box (STB), a personal digital assistant (PDA), an entertainment media system or system component, a cellular telephone, a smart phone, a mobile device, a wearable device (e.g., a smart watch), a smart home device (e.g., a smart appliance), other smart devices, a web appliance, a network router, a network switch, a network bridge, a headphone driver, or any machine capable of executing the instructions 1816, sequentially or otherwise, that specify actions to be taken by the machine 1800. Further, while only a single machine 1800 is illustrated, the term "machine" shall also be taken to include a collection of machines 1800 that individually or jointly execute the instructions 1816 to perform any one or more of the methodologies discussed herein.

The machine 1800 can include or use processors 1810, such as including an audio processor circuit, non-transitory memory/storage 1830, and I/O components 1850, which can be configured to communicate with each other such as via a bus 1802. In an example embodiment, the processors 1810 (e.g., a central processing unit (CPU), a reduced instruction set computing (RISC) processor, a complex instruction set computing (CISC) processor, a graphics processing unit (GPU), a digital signal processor (DSP), an ASIC, a radio-frequency integrated circuit (RFIC), another processor, or any suitable combination thereof) can include, for example, a circuit such as a processor 1812 and a processor 1814 that may execute the instructions 1816. The term "processor" is intended to include a multi-core processor 1812, 1814 that can comprise two or more independent processors 1812, 1814 (sometimes referred to as "cores") that may execute the instructions 1816 contemporaneously. Although FIG. 18 shows multiple processors 1810, the machine 1800 may include a single processor 1812, 1814 with a single core, a single processor 1812, 1814 with multiple cores (e.g., a multi-core processor 1812, 1814), multiple processors 1812, 1814 with a single core, multiple processors 1812, 1814 with multiples cores, or any combination thereof, wherein any one or more of the processors can include a circuit configured to apply a height filter to an audio signal to render a processed or virtualized audio signal.

The memory/storage 1830 can include a memory 1832, such as a main memory circuit, or other memory storage circuit, and a storage unit 1836, both accessible to the processors 1810 such as via the bus 1802. The storage unit 1836 and memory 1832 store the instructions 1816 embodying any one or more of the methodologies or functions described herein. The instructions 1816 may also reside, completely or partially, within the memory 1832, within the storage unit 1836, within at least one of the processors 1810 (e.g., within the cache memory of processor 1812, 1814), or any suitable combination thereof, during execution thereof by the machine 1800. Accordingly, the memory 1832, the storage unit 1836, and the memory of the processors 1810 are examples of machine-readable media.

As used herein, "machine-readable medium" means a device able to store the instructions 1816 and data temporarily or permanently and may include, but not be limited to, random-access memory (RAM), read-only memory (ROM), buffer memory, flash memory, optical media, magnetic media, cache memory, other types of storage (e.g., erasable programmable read-only memory (EEPROM)), and/or any suitable combination thereof. The term "machine-readable medium" should be taken to include a single medium or multiple media (e.g., a centralized or distributed database, or associated caches and servers) able to store the instructions 1816. The term "machine-readable medium" shall also be taken to include any medium, or combination of multiple media, that is capable of storing instructions (e.g., instructions 1816) for execution by a machine (e.g., machine 1800), such that the instructions 1816, when executed by one or more processors of the machine 1800 (e.g., processors 1810), cause the machine 1800 to perform any one or more of the methodologies described herein. Accordingly, a "machine-readable medium" refers to a single storage apparatus or device, as well as "cloud-based" storage systems or storage networks that include multiple storage apparatus or devices. The term "machine-readable medium" excludes signals per se.

The I/O components 1850 may include a variety of components to receive input, provide output, produce output, transmit information, exchange information, capture measurements, and so on. The specific I/O components 1850 that are included in a particular machine 1800 will depend on the type of machine 1800. For example, portable machines such as mobile phones will likely include a touch input device or other such input mechanisms, while a headless server machine will likely not include such a touch input device. It will be appreciated that the I/O components 1850 may include many other components that are not shown in FIG. 18. The I/O components 1850 are grouped by functionality merely for simplifying the following discussion, and the grouping is in no way limiting. In various example embodiments, the I/O components 1850 may include output components 1852 and input components 1854. The output components 1852 can include visual components (e.g., a display such as a plasma display panel (PDP), a light emitting diode (LED) display, a liquid crystal display (LCD), a projector, or a cathode ray tube (CRT)), acoustic components (e.g., loudspeakers), haptic components (e.g., a vibratory motor, resistance mechanisms), other signal generators, and so forth. The input components 1854 can include alphanumeric input components (e.g., a keyboard, a touch screen configured to receive alphanumeric input, a photo-optical keyboard, or other alphanumeric input components), point based input components (e.g., a mouse, a touchpad, a trackball, a joystick, a motion sensor, or other pointing instruments), tactile input components (e.g., a physical button, a touch screen that provides location and/or force of touches or touch gestures, or other tactile input components), audio input components (e.g., a microphone), and the like.

In further example embodiments, the I/O components 1850 can include biometric components 1856, motion components 1858, environmental components 1860, or position components 1862, among a wide array of other components. For example, the biometric components 1856 can include components to detect expressions (e.g., hand expressions, facial expressions, vocal expressions, body gestures, or eye tracking), measure biosignals (e.g., blood pressure, heart rate, body temperature, perspiration, or brain waves), identify a person (e.g., voice identification, retinal identification, facial identification, fingerprint identification, or electroencephalogram based identification), and the like, such as can influence a inclusion, use, or selection of a listener-specific or environment-specific impulse response or HRTF, for example. In an example, the biometric components 1856 can include one or more sensors configured to sense or provide information about a detected location of the listener 110 in an environment. The motion components 1858 can include acceleration sensor components (e.g., accelerometer), gravitation sensor components, rotation sensor components (e.g., gyroscope), and so forth, such as can be used to track changes in the location of the listener 110. The environmental components 1860 can include, for example, illumination sensor components (e.g., photometer), temperature sensor components (e.g., one or more thermometers that detect ambient temperature), humidity sensor components, pressure sensor components (e.g., barometer), acoustic sensor components (e.g., one or more microphones that detect reverberation decay times, such as for one or more frequencies or frequency bands), proximity sensor or room volume sensing components (e.g., infrared sensors that detect nearby objects), gas sensors (e.g., gas detection sensors to detect concentrations of hazardous gases for safety or to measure pollutants in the atmosphere), or other components that may provide indications, measurements, or signals corresponding to a surrounding physical environment. The position components 1862 can include location sensor components (e.g., a Global Position System (GPS) receiver component), altitude sensor components (e.g., altimeters or barometers that detect air pressure from which altitude may be derived), orientation sensor components (e.g., magnetometers), and the like.

Communication can be implemented using a wide variety of technologies. The I/O components 1850 can include communication components 1864 operable to couple the machine 1800 to a network 1880 or devices 1870 via a coupling 1882 and a coupling 1872 respectively. For example, the communication components 1864 can include a network interface component or other suitable device to interface with the network 1880. In further examples, the communication components 1864 can include wired communication components, wireless communication components, cellular communication components, near field communication (NFC) components, Bluetooth® components (e.g., Bluetooth® Low Energy), Wi-Fi® components, and other communication components to provide communication via other modalities. The devices 1870 can be another machine or any of a wide variety of peripheral devices (e.g., a peripheral device coupled via a USB).

Moreover, the communication components 1864 can detect identifiers or include components operable to detect identifiers. For example, the communication components 1864 can include radio frequency identification (RFID) tag reader components, NFC smart tag detection components, optical reader components (e.g., an optical sensor to detect one-dimensional bar codes such as Universal Product Code (UPC) bar code, multi-dimensional bar codes such as Quick Response (QR) code, Aztec code, Data Matrix, Dataglyph, MaxiCode, PDF49, Ultra Code, UCC RSS-2D bar code, and other optical codes), or acoustic detection components (e.g., microphones to identify tagged audio signals). In addition, a variety of information can be derived via the communication components 1864, such as location via Internet Protocol (IP) geolocation, location via Wi-Fi® signal triangulation, location via detecting an NFC beacon signal that may indicate a particular location, and so forth. Such identifiers can be used to determine information about one or more of a reference or local impulse response, reference or local environment characteristic, or a listener-specific characteristic.

In various example embodiments, one or more portions of the network 1880 can be an ad hoc network, an intranet, an extranet, a virtual private network (VPN), a local area network (LAN), a wireless LAN (WLAN), a wide area network (WAN), a wireless WAN (WWAN), a metropolitan area network (MAN), the Internet, a portion of the Internet, a portion of the public switched telephone network (PSTN), a plain old telephone service (POTS) network, a cellular telephone network, a wireless network, a network, another type of network, or a combination of two or more such networks. For example, the network 1880 or a portion of the network 1880 can include a wireless or cellular network and the coupling 1882 may be a Code Division Multiple Access (CDMA) connection, a Global System for Mobile communications (GSM) connection, or another type of cellular or wireless coupling. In this example, the coupling 1882 can implement any of a variety of types of data transfer technology, such as Single Carrier Radio Transmission Technology (1xRTT), Evolution-Data Optimized (EVDO) technology, General Packet Radio Service (GPRS) technology, Enhanced Data rates for GSM Evolution (EDGE) technology, third Generation Partnership Project (3GPP) including 3G, fourth generation wireless (4G) networks, Universal Mobile Telecommunications System (UMTS), High Speed Packet Access (HSPA), Worldwide Interoperability for Microwave Access (WiMAX), Long Term Evolution (LTE) standard, others defined by various standard-setting organizations, other long range protocols, or other data transfer technology. In an example, such a wireless communication protocol or network can be configured to transmit headphone audio signals from a centralized processor or machine to a headphone device in use by a listener.

The instructions 1816 can be transmitted or received over the network 1880 using a transmission medium via a network interface device (e.g., a network interface component included in the communication components 1864) and using any one of a number of well-known transfer protocols (e.g., hypertext transfer protocol (HTTP)). Similarly, the instructions 1816 can be transmitted or received using a transmission medium via the coupling 1872 (e.g., a peer-to-peer coupling) to the devices 1870. The term "transmission medium" shall be taken to include any intangible medium that is capable of storing, encoding, or carrying the instructions 1816 for execution by the machine 1800, and includes digital or analog communications signals or other intangible media to facilitate communication of such software.

Many variations of the concepts and examples discussed herein will be apparent to those skilled in the relevant arts. For example, depending on the embodiment, certain acts, events, or functions of any of the methods, processes, or algorithms described herein can be performed in a different sequence, can be added, merged, or omitted (such that not all described acts or events are necessary for the practice of the various methods, processes, or algorithms). Moreover, in some embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To illustrate this interchangeability of hardware and software, various components, blocks, modules, and process actions are, in some instances, described generally in terms of their functionality. Whether such functionality is implemented as hardware or software depends upon the particular application and design constraints imposed on the overall system. The described functionality can thus be implemented in varying ways for a particular application, but such implementation decisions should not be interpreted as causing a departure from the scope of this document. Embodiments of the immersive spatial audio reproduction systems and methods and techniques described herein are operational within numerous types of general purpose or special purpose computing system environments or configurations, such as described above in the discussion of FIG. 18.

Various aspects of the invention can be used independently or together. For example, Aspect 1 can include or use subject matter (such as an apparatus, a system, a device, a method, a means for performing acts, or a device readable medium including instructions that, when performed by the device, can cause the device to perform acts), such as can include or use a method for providing virtualized audio information in a three-dimensional soundfield using loudspeakers arranged in a first plane, wherein the virtualized audio information is perceived by a listener as including audible information in other than the first plane. In Aspect 1, the method can include receiving, using a first processor circuit, at least one height audio signal, the at least one height audio signal configured for use in audio reproduction using a loudspeaker that is offset from the first plane, and receiving, using the first processor circuit, localization information corresponding to the at least one height audio signal, the localization information including an azimuth parameter. Aspect 1 can further include selecting, using the first processor circuit, a first virtual height filter using information about the azimuth parameter, and generating a virtualized audio signal, including using the first processor circuit to apply the first virtual height filter to the at least one height audio signal, wherein the virtualized audio signal is configured for use in audio reproduction using one or more loudspeakers in the first plane, and wherein when the virtualized audio signal is reproduced using the one or more loudspeakers it is perceived by a listener as including audible information in other than the first plane. In an example, the first plane of Aspect 1 corresponds to a horizontal plane of the one or more loudspeakers used to reproduce the virtualized audio signal. In an example, the first plane of Aspect 1 corresponds to a horizontal plane of the listener. In another example, horizontal planes of the listener and the loudspeakers used to reproduce the virtualized audio signal are coincident, and the first plane of Aspect 1 corresponds to the coincident planes.

Aspect 2 can include or use, or can optionally be combined with the subject matter of Aspect 1, to optionally include the generating the virtualized audio signal includes generating the signal such that when the virtualized audio signal is reproduced using the one or more loudspeakers, the virtualized audio signal is perceived by the listener as including audible information that extends vertically upward or downward from a horizontal plane of the loudspeakers to a second plane.

Aspect 3 can include or use, or can optionally be combined with the subject matter of one or any combination of Aspects 1 or 2 to optionally include the generating the virtualized audio signal includes generating the signal such that when the virtualized audio signal is reproduced using the one or more loudspeakers, the virtualized audio signal is perceived by the listener as originating from an elevated or lowered source relative to a horizontal plane of the loudspeakers.

Aspect 4 can include or use, or can optionally be combined with the subject matter of one or any combination of Aspects 1 through 3 to optionally include the generating the virtualized audio signal includes applying horizontal-plane virtualization to the at least one height audio signal prior to applying the first virtual height filter.

Aspect 5 can include or use, or can optionally be combined with the subject matter of one or any combination of Aspects 1 through 3 to optionally include the generating the virtualized audio signal includes applying horizontal-plane virtualization to the at least one height audio signal after applying the first virtual height filter.

Aspect 6 can include or use, or can optionally be combined with the subject matter of one or any combination of Aspects 1 through 5 to optionally include using an audio signal mixer circuit, combining the virtualized audio signal with one or more other signals to be concurrently reproduced using the one or more loudspeakers in the first plane.

Aspect 7 can include or use, or can optionally be combined with the subject matter of one or any combination of Aspects 1 through 6 to optionally include the receiving the at least one height audio signal includes receiving information about first and second height audio channels intended for reproduction using different loudspeakers that are elevated relative to the first plane, wherein the first plane is a horizontal plane of the listener, wherein the receiving the localization information includes receiving respective azimuth parameters for the first and second height audio channels, wherein the selecting includes selecting different respective first and second virtual height filters using information about the respective azimuth parameters, and wherein the generating includes using the first processor circuit to apply the first and second virtual height filters to the first and second height audio channels, respectively, to provide respective first and second virtualized audio signals, wherein when the first and second virtualized audio signals are reproduced using loudspeakers in the horizontal plane, the reproduced signals are perceived by the listener as including audible information in other than the horizontal plane.

Aspect 8 can include or use, or can optionally be combined with the subject matter of Aspect 7, to optionally include the generating includes decorrelating the first and second height audio signals before applying the first and second virtual height filters.

Aspect 9 can include or use, or can optionally be combined with the subject matter of Aspect 7, to optionally include the respective azimuth parameters for the first and second height audio channels are substantially symmetrical azimuth angles, and wherein the selected different respective first and second virtual height filters include a sum filter and a difference filter based on ipsilateral and contralateral head-related transfer function data.

Aspect 10 can include or use, or can optionally be combined with the subject matter of one or any combination of Aspects 1 through 9 to optionally include the receiving the localization information further includes receiving an altitude parameter, and wherein the selecting the first virtual height filter includes using information about the azimuth parameter and using information about the altitude parameter.

Aspect 11 can include or use, or can optionally be combined with the subject matter of one or any combination of Aspects 1 through 10 to optionally include the selecting the first virtual height filter includes selecting a virtual height filter that is derived from a head-related transfer function.

Aspect 12 can include or use, or can optionally be combined with the subject matter of one or any combination of Aspects 1 through 11 to optionally include the generating the virtualized audio signal further includes using the first processor circuit to apply horizontal-plane spatialization to the virtualized audio signal.

Aspect 13 can include or use, or can optionally be combined with the subject matter of Aspect 12, to optionally include generating spatially-enhanced audio signals for a horizontal plane, including using the first processor circuit to apply horizontal-plane spatialization to other audio signals intended for reproduction using loudspeakers in the horizontal plane of the listener. Aspect 13 can further include mixing the virtualized audio signal with the spatially-enhanced audio signals to provide surround sound using the loudspeakers in the horizontal plane of the listener.

Aspect 14 can include, or can optionally be combined with the subject matter of one or any combination of Aspects 1 through 13 to include or use, subject matter (such as an apparatus, a method, a means for performing acts, or a machine readable medium including instructions that, when performed by the machine, that can cause the machine to perform acts), such as can include or use a system comprising means for receiving a height audio information signal configured for use in audio reproduction using a loudspeaker that is outside of a first plane of a listener, means for receiving localization information corresponding to the at least one height audio signal, the localization information including an azimuth parameter, means for selecting a virtualized height filter using the azimuth parameter, and means for generating a virtualized height audio information signal using the selected virtualized height filter and the received height audio information signal, and for storing the virtualized height audio information signal on a non-transitory computer-readable medium, wherein the virtualized height audio information signal is configured for use in audio reproduction using a loudspeaker in the first plane of the listener.

Aspect 15 can include or use, or can optionally be combined with the subject matter of Aspect 14 to optionally include the virtualized height audio information signal is configured for use in audio reproduction using the loudspeaker in the first plane of the listener to provide an audio image that extends vertically upward or downward from a horizontal plane of the loudspeaker used in the audio reproduction to a second plane.

Aspect 16 can include or use, or can optionally be combined with the subject matter of one or any combination of Aspects 14 or 15 to optionally include the virtualized height audio information signal is configured for use in audio reproduction using the loudspeaker in the first plane of the listener to provide an audio image that originates from a location that is offset vertically upward or downward from a horizontal plane of the loudspeaker used in the audio reproduction.

Aspect 17 can include or use, or can optionally be combined with the subject matter of one or any combination of Aspects 14 through 16 to optionally include means for applying horizontal-plane virtualization to the height audio information signal prior to generating the virtualized height audio information signal.

Aspect 18 can include or use, or can optionally be combined with the subject matter of one or any combination of Aspects 14 through 17 to optionally include means for combining the virtualized height audio information signal with one or more other signals to be concurrently reproduced using the loudspeaker in the first plane of the listener.

Aspect 19 can include or use, or can optionally be combined with the subject matter of one or any combination of Aspects 14 through 18 to optionally include means for decorrelating multiple channels of audio information in the height audio information signal to provide multiple decorrelated signals. In Aspect 19, the means for generating the virtualized height audio information signal can include means for generating the virtualized height audio information signal using the selected virtualized height filter and at least one of the multiple decorrelated signals.

Aspect 20 can include or use, or can optionally be combined with the subject matter of one or any combination of Aspects 14 through 19 to optionally include the means for selecting the virtualized height filter using the azimuth parameter includes means for selecting the virtualized height filter using an altitude parameter.

Aspect 21 can include or use, or can optionally be combined with the subject matter of one or any combination of Aspects 14 through 20 to optionally include means for generating the virtualized height filter using information about a head-related transfer function.

Aspect 22 can include, or can optionally be combined with the subject matter of one or any combination of Aspects 1 through 21 to include or use, subject matter (such as an apparatus, a method, a means for performing acts, or a machine readable medium including instructions that, when performed by the machine, that can cause the machine to perform acts), such as can include or use an audio signal processing system configured to provide virtualized audio information in a three-dimensional soundfield using loudspeakers in a horizontal plane, wherein the virtualized audio information is perceived by a listener as including audible information in other than the horizontal plane. In Aspect 22, the system includes an audio signal input configured to receive at least one height audio signal, the at least one height audio signal including audio signal information that is intended for reproduction using a loudspeaker that is elevated relative to a listener (e.g., relative to a horizontal plane associated with the listener), a localization signal input configured to receive localization information about the at least one height audio signal, the localization information including a first azimuth parameter, a memory circuit including one or more virtual height filters, wherein each of the virtual height filters is associated with one or more azimuth parameters, and an audio signal processor circuit configured to: retrieve a first virtual height filter from the memory circuit using the first azimuth parameter, and generate a virtualized audio signal by applying the first virtual height filter to the at least one height audio signal, wherein when the virtualized audio signal is reproduced using one or more loudspeakers in the horizontal plane, the virtualized audio signal is perceived by the listener as including audible information in other than the horizontal plane.

Aspect 23 can include or use, or can optionally be combined with the subject matter of Aspect 22, to optionally include a decorrelation circuit coupled to the audio signal input and configured to receive the at least one height audio signal, wherein the decorrelation circuit is configured to apply a decorrelation filter to one or more audio channels included in the height audio signal.

Aspect 24 can include or use, or can optionally be combined with the subject matter of one or any combination of Aspects 22 or 23 to optionally include a horizontal-plane virtualization processor circuit configured to apply horizontal-plane virtualization to at least one of the height audio signal and the virtualized audio signal.

Aspect 25 can include or use, or can optionally be combined with the subject matter of one or any combination of Aspects 22 through 24 to optionally include a mixer circuit configured to combine the virtualized audio signal with one or more other signals to be concurrently reproduced using the same loudspeakers.

Aspect 26 can include or use, or can optionally be combined with the subject matter of one or any combination of Aspects 22 through 25 to optionally include the audio signal processor circuit includes a head-related transfer function derivation circuit configured to derive the first virtual height filter based on ipsilateral and contralateral head-related transfer function information corresponding to the listener.

Aspect 27 can include, or can optionally be combined with the subject matter of one or any combination of Aspects 1 through 16 to include or use, subject matter (such as an apparatus, a method, a means for performing acts, or a machine readable medium including instructions that, when performed by the machine, that can cause the machine to perform acts), such as can include or use a method for virtual height processing of at least one height audio signal in a system with N audio input channels, wherein the at least one height audio signal corresponds to one of the N audio input channels. In Aspect 27, the method can include selecting M channels for a down-mixed audio output from the system, wherein N and M are non-zero positive integers and wherein M is less than N, receiving, using an audio signal processor circuit, information about a virtual localization for the at least one height audio signal, the information about the virtual localization including an azimuth parameter, and selecting, from a memory circuit, a virtual height filter for use with the at least one height audio signal, the selecting based on the azimuth parameter. Aspect 27 can further include providing, using the audio signal processor circuit, a virtualized audio signal using a virtualization processor circuit to process the at least one height audio signal using the selected virtual height filter that is based on the azimuth parameter, and mixing the virtualized audio signal with other audio signal information from one or more of the selected M channels to provide an output signal.

Aspect 28 can include or use, or can optionally be combined with the subject matter of Aspect 27 to optionally include deriving the virtual height filter from a head-related transfer function corresponding to the azimuth parameter and/or an altitude parameter.

Aspect 29 can include or use, or can optionally be combined with the subject matter of one or any combination of Aspects 27 or 28 to optionally include deriving the virtual height filter using a ratio of power signals and based on the azimuth parameter.

Aspect 30 can include or use, or can optionally be combined with the subject matter of one or any combination of Aspects 27 through 29 to optionally include applying horizontal-plane spatialization to the output signal.

Aspect 31 can include or use, or can optionally be combined with the subject matter of one or any combination of Aspects 27 through 30 to optionally include the providing the virtualized audio signal includes applying a decorrelation filter to at least one of multiple channels of the at least one height audio signal.

Aspect 32 can include or use, or can optionally be combined with the subject matter of one or any combination of Aspects 27 through 31 to optionally include wherein the at least one height audio signal includes signal information in each of two channels, wherein the receiving the information about the virtual localization includes receiving azimuth parameters respectively corresponding to the signal information in the two channels, wherein the azimuth parameters include substantially symmetrical virtual localization azimuth angles, and wherein the selecting the virtual height filter includes selecting a sum filter and a difference filter that are based on ipsilateral and contralateral head-related transfer function data, respectively.

Aspect 33 can include or use, or can optionally be combined with the subject matter of one or any combination of Aspects 27 through 32 to optionally include the mixing includes mixing the signals to render a two-channel headphone audio signal.

Aspect 34 can include, or can optionally be combined with the subject matter of one or any combination of Aspects 1 through 33 to include or use, subject matter (such as an apparatus, a method, a means for performing acts, or a machine readable medium including instructions that, when performed by the machine, that can cause the machine to perform acts), such as can include or use a method to vertically extend audible artifact height in an audio signal that is reproduced using loudspeakers provided substantially within a first plane. In Aspect 34, the method can include receiving, using a first processor circuit, a first audio input signal, the audio input signal intended for reproduction using at least one of multiple loudspeakers provided in a first plane of a listener, delaying the input audio signal and, using the first processor circuit, applying a virtual height filter to the first input audio signal to provide a virtualized height signal, and combining, using the first processor circuit, the virtualized height signal and the audio input signal to provide a processed audio signal, wherein the processed audio signal is configured for reproduction using one or more of the multiple loudspeakers provided in the first plane of the listener to provide an audible artifact that extends vertically from the first plane.

Aspect 35 can include or use, or can optionally be combined with the subject matter of Aspect 34 to optionally include deriving the virtual height filter from a head-related transfer function corresponding to an azimuth angle and an altitude angle associated with the vertically extended audible artifact.

Aspect 36 can include or use, or can optionally be combined with the subject matter of one or any combination of Aspects 34 or 35 to optionally include the first audio input signal comprises information in at least two channels, and wherein the delaying applying the virtual height filter to the first input audio signal further comprises applying a decorrelation filter to at least one of the two channels prior to the combining the virtualized height signal and the audio input signal to provide the processed audio signal.

Aspect 37 can include or use, or can optionally be combined with the subject matter of one or any combination of Aspects 34 through 36 to optionally include applying a spectral correction filter to the virtualized height signal to attenuate or amplify low frequency information in the signal.

Aspect 38 can include, or can optionally be combined with the subject matter of one or any combination of Aspects 1 through 37 to include or use, subject matter (such as an apparatus, a method, a means for performing acts, or a machine readable medium including instructions that, when performed by the machine, that can cause the machine to perform acts), such as can include or use a method for virtualization processing of an audio signal that includes two or more audio information channels. In Aspect 38, the method can include receiving, using a first processor circuit, an audio signal that includes multiple audio information channels, applying, using the first processor circuit, a decorrelation filter to at least one of the multiple audio information channels to provide at least one filtered channel, and generating a virtualized audio signal, including using the first processor circuit to apply virtualization processing to the at least one filtered channel, the virtualization processing configured to adjust a listener-perceived localization of audible information in the virtualized audio signal when the virtualized audio signal is provided to a listener using loudspeakers or headphones.

Aspect 39 can include or use, or can optionally be combined with the subject matter of Aspect 38 to optionally include the generating the virtualized audio signal further comprises applying a virtual height filter to the at least one filtered channel, wherein the virtual height filter is derived from a head-related transfer function.

Aspect 40 can include or use, or can optionally be combined with the subject matter of one or any combination of Aspects 38 or 39 to optionally include the generating the virtualized audio signal further comprises applying a virtual height filter to the at least one filtered channel, wherein the virtual height filter is derived from a power ratio of multiple head-related transfer functions.

Aspect 41 can include or use, or can optionally be combined with the subject matter of Aspect 40 to optionally include deriving the virtual height filter using magnitude information from first and second head-related transfer functions respectively associated with an audio source that is offset from a listener in an azimuth direction and in an elevation direction.

Aspect 42 can include or use, or can optionally be combined with the subject matter of one or any combination of Aspects 38 through 41 to optionally include the applying the decorrelation filter includes applying an all-pass filter to the at least one of the multiple audio information channels to provide the at least one filtered channel.

Aspect 43 can include or use, or can optionally be combined with the subject matter of one or any combination of Aspects 38 through 42 to optionally include the generating the virtualized audio signal includes applying a head-related transfer function-based filter to adjust the perceived localization of an origin of audible information in the virtualized audio signal when the virtualized audio signal is reproduced using loudspeakers or headphones.

Aspect 44 can include, or can optionally be combined with the subject matter of one or any combination of Aspects 1 through 43 to include or use, subject matter (such as an apparatus, a method, a means for performing acts, or a machine readable medium including instructions that, when performed by the machine, that can cause the machine to perform acts), such as can include or use a system including means for receiving an audio signal that includes multiple audio information channels, means for decorrelating the multiple audio information channels and providing at least one filtered channel, and means for generating a virtualized audio signal using the at least one filtered channel, wherein the virtualized audio signal is configured for use in audio reproduction using a loudspeaker in a first plane of a listener to produce a listener-perceived localization of audible information outside of the first plane.

Aspect 45 can include or use, or can optionally be combined with the subject matter of Aspect 44 to optionally include the first plane is a horizontal plane of the loudspeaker and the virtualized audio signal is configured for use in audio reproduction using the loudspeaker to produce a listener-perceived localization of audible information that extends above or below the horizontal plane.

Aspect 46 can include or use, or can optionally be combined with the subject matter of one or any combination of Aspects 44 or 45 to optionally include the first plane is a horizontal plane of the loudspeaker and the virtualized audio signal is configured for use in audio reproduction using the loudspeaker to produce a listener-perceived localization of audible information that originates above or below the horizontal plane.

Aspect 47 can include or use, or can optionally be combined with the subject matter of one or any combination of Aspects 44 through 46 to optionally include the means for generating the virtualized audio signal includes means for applying a head-related transfer function-based virtualization filter to the at least one filtered channel.

Aspect 48 can include or use, or can optionally be combined with the subject matter of one or any combination of Aspects 44 through 47 to optionally include means for applying horizontal-plane virtualization to the filtered channel prior to generating the virtualized audio signal.

Aspect 49 can include or use, or can optionally be combined with the subject matter of one or any combination of Aspects 44 through 48 to optionally include means for combining the virtualized audio signal with one or more other signals to be concurrently reproduced using the loudspeaker in the first plane of the listener to produce listener-perceived localization of audible information inside the first plane and outside the first plane.

Each of these non-limiting Aspects can stand on its own, or can be combined in various permutations or combinations with one or more of the other Aspects or examples provided herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated in this document, the terms "including" and "in which" are used as the plain-English equivalents of the respective terms "comprising" and "wherein."

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

Moreover, although the subject matter has been described in language specific to structural features or methods or acts, it is to be understood that the subject matter defined in the appended claims is not necessarily limited to the specific features or acts described above. Rather, the specific features and acts described above are disclosed as example forms of implementing the claims.

What is claimed is:

1. A method for providing a three-dimensional soundfield using loudspeakers in a transverse plane, wherein the soundfield includes audio information that is perceived by a listener as including information in an elevated plane, the method comprising:

receiving a multiple-channel input including:

at least two height audio signals with information about one or more height audio sources, the height audio signals configured for reproduction together to provide the one or more height audio sources using respective differently-positioned loudspeakers that are outside of the transverse plane, and transverse-plane audio signals configured for reproduction using respective loudspeakers in the transverse plane;

receiving respective azimuth parameters for each of the height audio signals;

receiving respective height parameters for each of the height audio signals;

generating first virtualized audio signals by applying respective different inter-channel decorrelation processing filters and pairwise virtualization processing to the at least two height audio signals as-received, the pairwise virtualization processing using filters based on the height parameters for the height audio signals, and the decorrelation processing filters configured to enhance a localization, perceived by the listener, of one or more phantom sources in the soundfield; and generating a multiple-channel output by combining the first virtualized audio signals with the transverse-plane audio signals, wherein combining the audio signals includes using the azimuth parameters for the height audio signals, and wherein generating the multiple-channel output includes generating second virtualized audio signals by applying other virtualization processing to the first virtualized audio signals and the transverse-plane audio signals together, the other virtualization processing using horizontal plane filters based on the azimuth parameters for the height audio signals, and providing the multiple-channel output using the second virtualized audio signals, wherein the multiple-channel output comprises signals configured for reproduction using respective different loudspeakers in the transverse plane to provide the three-dimensional soundfield.

2. The method of claim 1, wherein the one or more phantom sources comprise a portion of an audio image that originates from a location that is offset vertically upward or downward from the transverse plane.

3. The method of claim 1, wherein generating the first virtualized audio signals includes using a head-related transfer function selected based on at least one of the height parameters.

4. The method of claim 1, wherein generating the first virtualized audio signals includes applying the respective inter-channel decorrelation processing filters to the height audio signals as-received to provide decorrelated height signals and then applying the pairwise virtualization processing to the decorrelated height signals.

5. The method of claim 1, wherein generating the first virtualized audio signals includes applying the pairwise virtualization processing to the height audio signals as-received to provide intermediate virtualized audio signals and then applying the respective inter-channel decorrelation processing filters to the intermediate virtualized audio signals.

6. The method of claim 1, wherein generating the multiple-channel output comprises mixing the first virtualized audio signals and the transverse-plane audio signals together to provide the output.

7. The method of claim 6, further comprising generating second virtualized audio signals by applying other virtualization processing to the multiple-channel output, the other virtualization processing using horizontal plane filters based on the azimuth parameters for the height audio signals.

8. The method of claim 1, wherein generating the multiple-channel output comprises:

generating second virtualized audio signals by applying other virtualization processing to the transverse plane audio signals; and combining the first virtualized audio signals with the second virtualized audio signals using the azimuth parameters for the height audio signals.

9. The method of claim 1, wherein at least two of the signals in the multiple-channel output comprise information from the at least two height audio signals.

10. An audio signal processing system configured to provide a three-dimensional soundfield using loudspeakers in a transverse plane, wherein the soundfield includes audio information that is perceived by a listener as including information in an elevated plane, the system comprising:

a first audio signal input configured to receive at least two height audio signals configured for reproduction together, to provide one or more height audio sources, using respective differently-positioned loudspeakers that are elevated relative to the transverse plane;

a second audio signal input configured to receive transverse-plane audio signals configured for reproduction using respective loudspeakers in the transverse plane;

a localization signal input configured to receive respective azimuth and height parameters for each of the height audio signals; and an audio signal processor circuit configured to:

generate first virtualized audio signals by applying respective different inter-channel decorrelation processing filters and pairwise virtualization processing to the height audio signals as-received, the pairwise virtualization processing using filters based on the height parameters for the height audio signals, and the decorrelation processing filters configured to enhance a localization, perceived by the listener, of one or more phantom sources in the soundfield; and generate a multiple-channel output by combining the first virtualized audio signals with the transverse-plane audio signals, and applying other virtualization processing to the first virtualized audio signals and the transverse-plane audio signals together, the other virtualization processing using horizontal plane filters based on the azimuth parameters for the height audio signals, wherein combining the audio signals includes using the azimuth parameters for the height audio signals, wherein the multiple-channel output comprises signals configured for reproduction using respective different loudspeakers in the transverse plane to provide the three-dimensional soundfield.

11. The system of claim 10, wherein the audio signal processor circuit comprises an audio signal mixer circuit configured to combine the first virtualized audio signals with the transverse-plane audio signals to provide the multiple-channel output.

12. The system of claim 10, wherein the audio signal processor circuit comprises a traverse-plane surround sound processor configured to receive the multiple-channel output and, in response, provide a two-channel output representative of the three-dimensional soundfield.

13. The system of claim 10, wherein the one or more phantom sources comprise a portion of the three-dimensional soundfield that is perceived by the listener to originate from a location that is offset vertically from the transverse plane.

14. The system of claim 10, wherein the audio signal processor circuit is configured to generate the first virtualized audio signals by applying the respective different inter-channel decorrelation processing filters to the height audio signals as-received to provide decorrelated height signals and then applying the pairwise virtualization processing to the decorrelated height signals.

15. The system of claim 10, wherein the audio signal processor circuit is configured to generate the first virtualized audio signals by applying the pairwise virtualization processing to the height audio signals as-received to provide intermediate virtualized audio signals and then applying the respective different inter-channel decorrelation processing filters to the intermediate virtualized audio signals.

16. A system for providing signals representative of a three-dimensional soundfield, the signals configured for loudspeakers in a horizontal plane, wherein the soundfield includes audio information that is perceived by a listener as including information outside of the horizontal plane, the system comprising:

means for receiving a multiple-channel input including:

at least two height audio signals configured for reproduction together, to provide one or more height audio sources, using respective differently-positioned loudspeakers that are outside of the transverse plane, and transverse-plane audio signals configured for reproduction using respective loudspeakers in the transverse plane;

means for receiving respective azimuth parameters for each of the height audio signals;

means for receiving respective height parameters for each of the height audio signals;

means for generating first virtualized audio signals by applying respective different inter-channel decorrelation processing filters and pairwise virtualization processing to the height audio signals, the pairwise virtualization processing using filters based on the height parameters for the height audio signals, and the decorrelation processing filters configured to enhance a localization, perceived by the listener, of one or more phantom sources in the soundfield; and means for generating a multiple-channel output by combining the first virtualized audio signals with the transverse-plane audio signals, and applying other virtualization processing to the first virtualized audio signals and the transverse-plane audio signals together, the other virtualization processing using horizontal plane filters based on the azimuth parameters for the height audio signals, wherein combining the audio signals includes using the azimuth parameters for the height audio signals, wherein the multiple-channel output comprises signals configured for reproduction using respective different loudspeakers in the transverse plane to provide the three-dimensional soundfield.

17. The system of claim 16, wherein the means for generating the first virtualized audio signals includes:

means for applying the inter-channel decorrelation processing filters to the respective height audio signals to provide decorrelated signals, and means for applying pairwise virtualization processing to the decorrelated signals to provide the first virtualized audio signals.

18. The system of claim 16, wherein the means for generating the first virtualized audio signals includes:

means for applying pairwise virtualization processing to the height audio signals to provide intermediate virtualized audio signals, and means for applying the inter-channel decorrelation processing filters to the respective intermediate virtualized audio signals to provide the first virtualized audio signals.

* * * * *